US010018438B2

(12) United States Patent
Biran

(10) Patent No.: US 10,018,438 B2
(45) Date of Patent: Jul. 10, 2018

(54) DEVICE AND METHOD FOR BLOCKING DISCHARGE IN FIREARMS

(71) Applicant: CLIPFORT L.T.D BV, Amsterdam (NL)

(72) Inventor: Daniel Biran, Ramat Hasharon (IL)

(73) Assignee: CLIPFORT L.T.D BV, Amsterdam (NL)

( * ) Notice: Subject to any disclaimer, the term of this patent is extended or adjusted under 35 U.S.C. 154(b) by 0 days.

(21) Appl. No.: 15/059,350

(22) Filed: Mar. 3, 2016

(65) Prior Publication Data

US 2017/0146310 A1 May 25, 2017

Related U.S. Application Data

(63) Continuation-in-part of application No. 14/945,536, filed on Nov. 19, 2015.

(51) Int. Cl.

| | |
|---|---|
| ***F41A 17/46*** | (2006.01) |
| ***F41A 17/36*** | (2006.01) |
| ***F41A 17/38*** | (2006.01) |
| ***F41A 9/64*** | (2006.01) |
| ***F41C 3/00*** | (2006.01) |
| ***F41A 17/06*** | (2006.01) |
| ***F41A 17/08*** | (2006.01) |

(52) U.S. Cl.

CPC ..... *F41A 17/46* (2013.01); *F41A 9/64* (2013.01); *F41A 17/063* (2013.01); *F41A 17/066* (2013.01); *F41A 17/08* (2013.01); *F41A 17/36* (2013.01); *F41A 17/38* (2013.01); *F41C 3/00* (2013.01)

(58) Field of Classification Search

CPC ..... F41A 17/34; F41A 17/36; F41A 17/38; F41A 17/46

USPC ..... 42/1.01, 1.02, 1.05, 70.06

See application file for complete search history.

(56) References Cited

U.S. PATENT DOCUMENTS 4,619,062 A * 10/1986 Johnson ..... F41A 17/42 42/49.02
5,052,138 A * 10/1991 Crain ..... F41A 9/62 42/1.02
5,379,541 A * 1/1995 Bammate ..... F41A 9/59 42/18
5,628,134 A * 5/1997 Wesp ..... F41A 17/38 42/50
5,636,464 A * 6/1997 Ciluffo ..... F41A 17/066 340/5.52

(Continued)

*Primary Examiner* — Derrick R Morgan
(74) *Attorney, Agent, or Firm* — Bennet K. Langlotz; Langlotz Patent & Trademark Works, Inc.

(57) ABSTRACT

A discharge blocking device compatible with a firearm that has a magazine housing. The safety magazine comprises a cover that has a shape compatible with the magazine housing, a base that covers a locking mechanism, and a locking element that at least partially accommodates inside the cover. The locking element is configured to allow blocking the trigger of the firearm. A method for locking a magazine to a firearm and preventing accidental discharge is disclosed. The method comprises providing a cover, that has a shape compatible with the magazine housing, providing a base, covering a locking mechanism, providing a locking element, and inserting the cover into the magazine housing, wherein the locking element is configured to allow blocking the trigger.

20 Claims, 16 Drawing Sheets

(56) References Cited

U.S. PATENT DOCUMENTS 5,782,029 A * 7/1998 Brooks ..... F41A 17/02 42/70.11
5,826,360 A * 10/1998 Herold ..... F41A 9/62 42/1.02
5,946,840 A * 9/1999 Mickel ..... F41A 17/06 42/70.11
5,974,717 A * 11/1999 Brooks ..... F41A 17/02 42/70.02
5,987,796 A * 11/1999 Brooks ..... F41A 17/02 42/70.11
6,237,271 B1 * 5/2001 Kaminski ..... F41A 17/063 42/70.01
6,253,479 B1 * 7/2001 Fuchs ..... F41A 17/36 42/70.02
6,256,919 B1 * 7/2001 Brazeau ..... F41A 17/44 42/70.04
6,286,242 B1 * 9/2001 Klebes ..... F41A 17/066 42/70.01
6,321,478 B1 * 11/2001 Klebes ..... F41A 17/066 42/70.11
6,351,906 B1 * 3/2002 Honig, Jr. ..... F41A 17/063 42/66
6,357,156 B1 * 3/2002 Klebes ..... F41A 17/066 42/70.01
6,412,207 B1 * 7/2002 Crye ..... F41A 17/02 42/70.01
6,442,880 B1 * 9/2002 Allan ..... F41A 17/066 42/66
6,457,271 B1 * 10/2002 Vaid ..... F41A 17/36 42/11
6,519,887 B1 * 2/2003 Allen ..... F41A 17/36 42/70.01
6,631,579 B1 * 10/2003 Lauster ..... F41A 17/066 42/70.01
6,655,066 B2 * 12/2003 Fluhr ..... F41A 17/36 42/70.02
7,222,450 B2 * 5/2007 Cuprin ..... F41A 17/066 42/70.11
7,568,302 B1 * 8/2009 Bubits ..... F41A 17/56 42/70.01
8,205,372 B2 * 6/2012 Anzeloni ..... F41A 17/063 42/70.01
8,215,048 B2 * 7/2012 Summers ..... F41A 17/063 42/70.06
8,740,026 B2 * 6/2014 Osborne ..... F41A 17/063 224/193
8,887,431 B2 * 11/2014 Horanoff ..... F41A 17/04 42/70.01
9,057,571 B2 * 6/2015 Kemmerer ..... F41A 17/20
9,354,011 B2 * 5/2016 Cooke ..... F41A 17/063
2002/0069570 A1 * 6/2002 Lee ..... F41A 7/08 42/70.11
2005/0246933 A1 * 11/2005 McGarry ..... F41A 17/36 42/70.02
2006/0080881 A1 * 4/2006 Cuprin ..... F41A 17/066 42/70.02
2011/0252682 A1 * 10/2011 Delgado Acarreta ..... F41A 9/62 42/1.02
2013/0019510 A1 * 1/2013 Kemmerer ..... F41A 17/066 42/1.01
2014/0305018 A1 * 10/2014 Horanoff ..... F41A 17/04 42/70.11
2015/0377574 A1 * 12/2015 Cooke ..... F41A 17/063 42/70.11
2016/0054081 A1 * 2/2016 Creed ..... F41A 17/066 42/70.06
2016/0069627 A1 * 3/2016 Cobb ..... F41A 17/36 42/70.02
2016/0169608 A1 * 6/2016 Schulz ..... F41A 33/02 434/22
2016/0252317 A1 * 9/2016 Biran ..... F41A 9/65 42/1.01

* cited by examiner

DEVICE AND METHOD FOR BLOCKING DISCHARGE IN FIREARMS

CROSS REFERENCE TO RELATED APPLICATION

This application is a continuation-in-part of U.S. patent application Ser. No. 14/945,536, filed Nov. 19, 2015, which is incorporated herein by reference.

FIELD OF THE INVENTION

The present invention relates to firearms. More particularly, the present invention relates to a safety magazine for various firearms.

BACKGROUND OF THE INVENTION

In recent years, there has been an increase in the number of accidental, negligent or unauthorized discharge from various firearms, and particularly handguns. Such incidents typically occur when the trigger of the firearm is deliberately pulled for a purpose other than shooting, such as dry-fire practice, demonstration or function testing, but the ammunition is unintentionally left in the chamber. Unintentionally leaving a firearm loaded is more likely to occur when the individual handling the gun is poorly trained, and perhaps also with removable-magazine-fed firearms (as the magazine may be removed, giving an unloaded appearance even when a round remains chambered). Since most handguns are designed such that the magazine constantly remains inside, thus keeping the handgun constantly loaded, such accidental or otherwise undesired or unauthorized discharge is more likely to occur.

A second common cause of negligent discharges is placement by the gun-handler of his/her finger on the trigger before deciding to shoot. With the finger so positioned, many activities may cause the finger to compress the trigger unintentionally. For example, if one attempts to holster the firearm with finger on trigger, the holster edge might drive the finger onto the trigger, and discharge is likely.

Accidental discharges not involving a trigger-pull can also occur if the firearm is mechanically unsound: due to poor maintenance, abuse or the use of defective ammunition in the gun, may all lead to breakage.

Furthermore, recently there has been a sharp increase in misuse of firearms with unauthorized users firing (for fun or by accident), and particularly youngsters using their parents' firearms. Such incidents cause many injuries (and sometimes fatalities) since there are no means to prevent other people from using a gun of an authorized user.

It would, therefore, be advantageous to provide safety means for firearms so as to prevent unintentional and/or unauthorized firing.

An object of the present invention is to provide a safety magazine for a firearm.

A further object of the present invention is to provide a method for blocking a firearm and preventing accidental discharge. Further objects of the present invention will be apparent as the description proceeds.

SUMMARY OF THE INVENTION

There is thus provided, in accordance with a preferred embodiment of the present invention, a safety magazine compatible with a firearm having a magazine housing, the safety magazine comprising a top cover, having a shape compatible with the magazine housing; a bottom cover, covering a locking mechanism; and a top locking element, at least partially accommodated inside the top cover, wherein the locking element is configured to allow locking the safety magazine to the magazine housing.

Furthermore, in accordance with a preferred embodiment of the present invention, the top cover comprises a top portion that is configured to couple with the magazine housing.

Furthermore, in accordance with a preferred embodiment of the present invention, the magazine further comprises a dedicated space for accommodation of bullets.

Furthermore, in accordance with a preferred embodiment of the present invention, the magazine further comprises a control element configured to allow switching between locked and unlocked modes by a user.

Furthermore, in accordance with a preferred embodiment of the present invention, the control element comprises at least one biometric identification unit.

Furthermore, in accordance with a preferred embodiment of the present invention, the magazine further comprises a mechanical identification override device.

Furthermore, in accordance with a preferred embodiment of the present invention, the magazine further comprises a bottom locking element.

Furthermore, in accordance with a preferred embodiment of the present invention, the top cover further comprises an opening corresponding in size to the locking element so as to allow the locking element to pass through the opening and engage the magazine housing.

Furthermore, in accordance with a preferred embodiment of the present invention, the top cover engages the magazine cover so as to block the operation of the firearm.

Furthermore, in accordance with a preferred embodiment of the present invention, the magazine further comprises a power storage unit.

Furthermore, in accordance with a preferred embodiment of the present invention, the power storage unit is connected to the bottom cover.

Furthermore, in accordance with a preferred embodiment of the present invention, the locking mechanism comprises a cam.

Furthermore, in accordance with a preferred embodiment of the present invention, the cam comprises a tooth that is configured to engage the top locking element.

Furthermore, in accordance with a preferred embodiment of the present invention, the magazine further comprises a communication unit capable of receiving wireless data, and wherein the operation of the locking mechanism corresponds to the received data.

Furthermore, in accordance with a preferred embodiment of the present invention, a method for locking a magazine to a firearm is provided, the firearm having a magazine housing, and the method comprising providing a top cover, having a shape compatible with the magazine housing; providing a bottom cover, covering a locking mechanism; providing a top locking element, at least partially accommodated inside the top cover; and inserting the top cover into the magazine housing, wherein the locking element is configured to allow locking the safety magazine to the magazine housing.

There is thus provided, in accordance with a further preferred embodiment of the present invention, a discharge blocking device compatible with a firearm having a magazine housing and a trigger, the discharge blocking device comprising a cover, having a shape compatible with the magazine housing, a base, covering a locking mechanism, and a locking element, at least partially accommodated inside the cover, wherein the locking element is configured to allow blocking the trigger of the firearm.

Furthermore, in accordance with a preferred embodiment of the present invention, the locking element is configured to allow locking the discharge blocking device to the magazine housing.

Furthermore, in accordance with a preferred embodiment of the present invention, the cover is configured to couple with the magazine housing.

Furthermore, in accordance with a preferred embodiment of the present invention, the discharge blocking device further comprises a positioning lever configured to allow indication upon accommodation of the discharge blocking device within the magazine housing.

Furthermore, in accordance with a preferred embodiment of the present invention, the discharge blocking device further comprises a dedicated space for accommodation of bullets.

Furthermore, in accordance with a preferred embodiment of the present invention, the discharge blocking device further comprises at least one user identification unit.

Furthermore, in accordance with a preferred embodiment of the present invention, the user identification unit comprises biometric identification.

Furthermore, in accordance with a preferred embodiment of the present invention, the discharge blocking device further comprises a mechanical identification override device.

Furthermore, in accordance with a preferred embodiment of the present invention, the mechanical identification override device comprises a media device.

Furthermore, in accordance with a preferred embodiment of the present invention, the discharge blocking device further comprises an indicator to indicate if the discharge blocking device is inserted into the magazine housing, said indicator is configured to disable the operation of the control element when said discharge blocking device is not inserted into said magazine housing.

Furthermore, in accordance with a preferred embodiment of the present invention, the discharge blocking device further comprises a power storage unit.

Furthermore, in accordance with a preferred embodiment of the present invention, the discharge blocking device further comprises an indicator of the status of the power storage unit.

Furthermore, in accordance with a preferred embodiment of the present invention, the locking mechanism comprises a cam.

Furthermore, in accordance with a preferred embodiment of the present invention, the cam comprises a tooth that is configured to engage the locking element.

Furthermore, in accordance with a preferred embodiment of the present invention, the discharge blocking device further comprises a communication unit capable of sending and receiving wireless data, and wherein the operation of the locking mechanism corresponds to the wireless data.

Furthermore, in accordance with a preferred embodiment of the present invention, the cover further comprises a window corresponding in size to the locking element so as to allow the locking element to pass through the window and engage the magazine housing.

Furthermore, in accordance with a preferred embodiment of the present invention, the locking element is pivoted about a pivot.

Furthermore, in accordance with a preferred embodiment of the present invention, a method for locking a magazine to a firearm and preventing accidental discharge is provided, the firearm having a magazine housing and a trigger, and the method comprising providing a cover of the magazine, having a shape compatible with the magazine housing, providing a base of the magazine, covering a locking mechanism, providing a locking element of the magazine, at least partially accommodated inside the cover, and inserting the cover of the magazine into the magazine housing, wherein the locking element is configured to allow locking the trigger.

Furthermore, in accordance with a preferred embodiment of the present invention, the locking element is configured to allow locking the magazine to the magazine housing.

Furthermore, in accordance with a preferred embodiment of the present invention, the method further comprises using a user identification segment to identify a user, and unlocking the trigger.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1A:
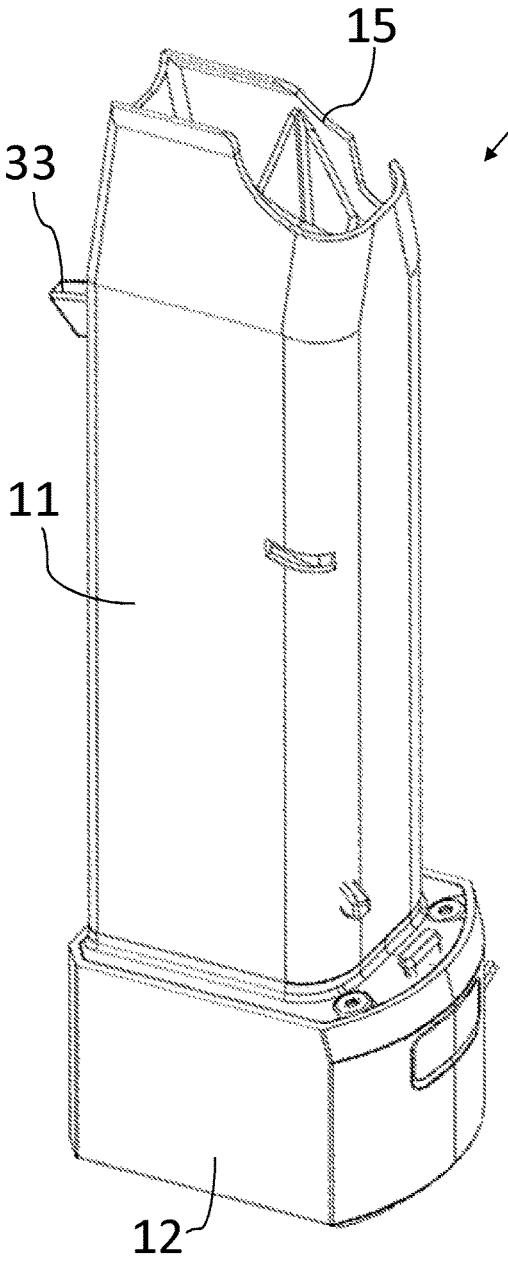
FIG. 1A illustrates a frontal perspective view of a safety magazine, according to a preferred embodiment of the present invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of embodiments of the invention. However, it will be understood by those of ordinary skill in the art that the embodiments of the invention may be practiced without these specific details. In other instances, well-known methods, procedures, and components have not been described in detail so as not to obscure the embodiments of the invention.

Figure 1B:
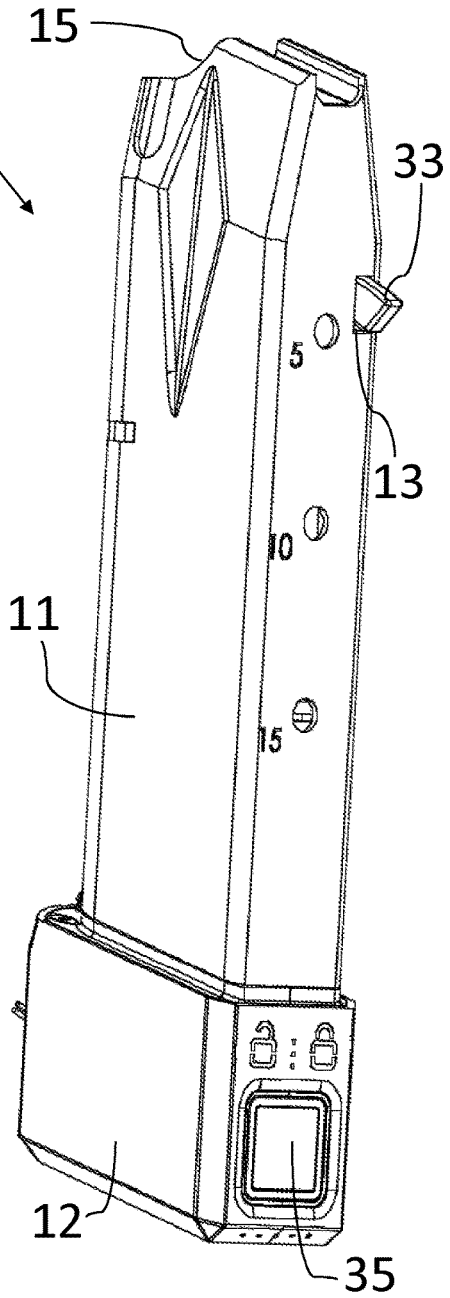
FIG. 1B illustrates a back perspective view of the safety magazine, according to a preferred embodiment of the present invention.

Reference is now made to FIGS. 1A-1B, which illustrate a safety magazine, generally designated 10, according to a preferred embodiment of the present invention. FIG. 1A illustrates a frontal perspective view of a safety magazine 10, and FIG. 1B illustrates a back perspective view of safety magazine 10.

Safety magazine 10 comprises a top cover 11 having a structure compatible with commercially available magazines for firearms, for instance having a shape corresponding to and adapted to be inserted into a magazine housing of, for example, a Beretta® 6-bullet handgun. Safety magazine 10 further comprises a bottom cover 12 that at least partially covers the safety mechanism, further described hereinafter. Optionally, top cover 11 has a top portion 15 that is configured to couple with the magazine housing in a compatible firearm. It is appreciated that a top locking element (or latch) 33 is designed to be capable of protruding from an opening 13 in top cover 11, whereby the operation of top locking element 33 is configured to allow locking safety magazine 10 to the magazine housing when locking element 33 protrudes from the magazine 10, further described herein after.

Figure 1C:
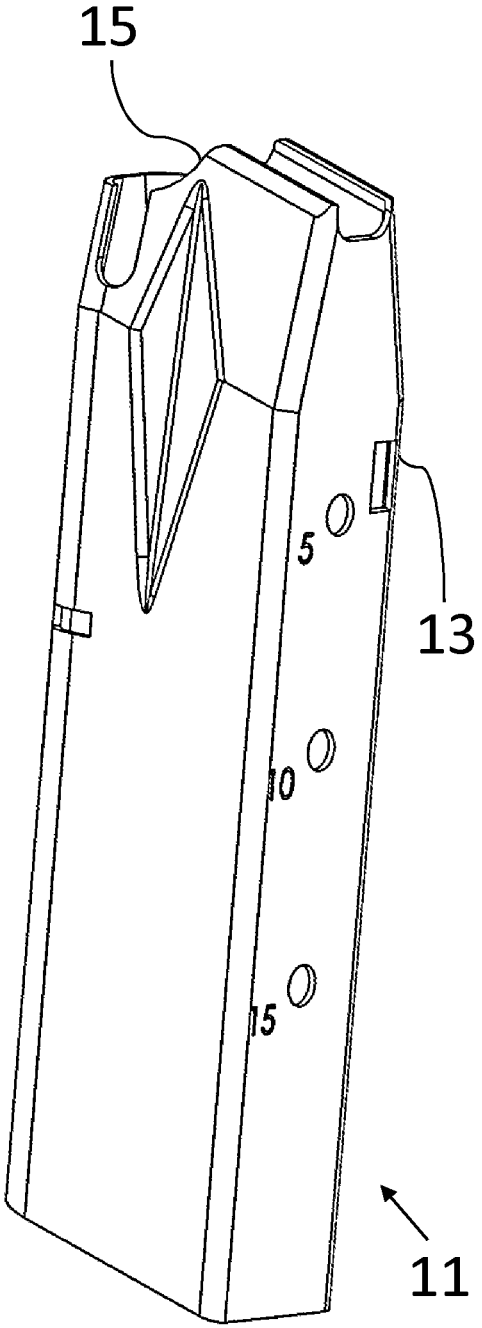
FIG. 1C illustrates a back perspective view of a top cover of the safety magazine, according to a preferred embodiment of the present invention.
Figure 1D:
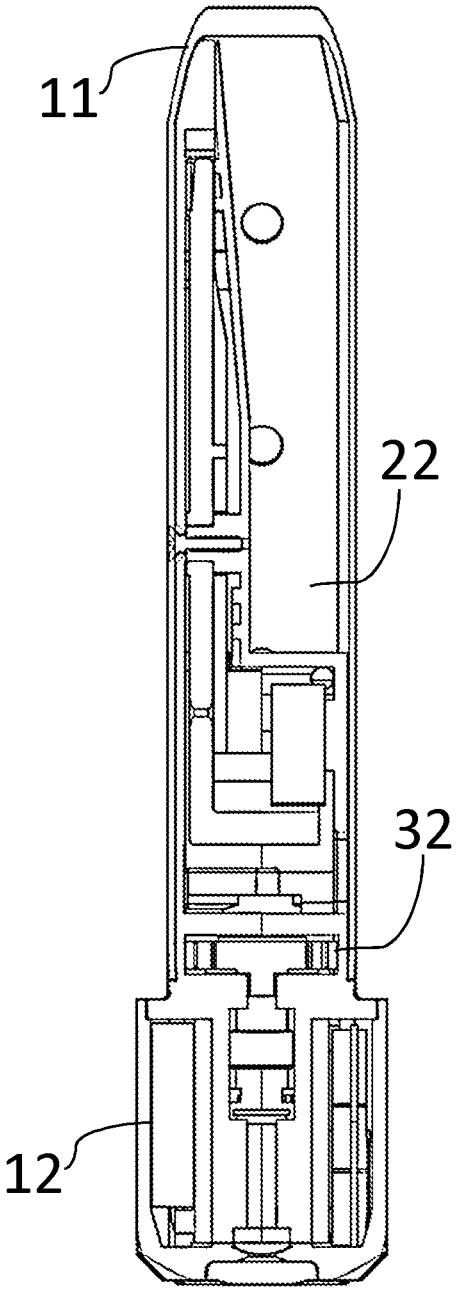
FIG. 1D illustrates a cross-sectional view of the safety magazine, according to a preferred embodiment of the present invention.

Reference is now made to FIGS. 1C-1D, which illustrate a back perspective view of top cover 11 of safety magazine 10 and a cross-sectional view of safety magazine 10 (respectively), according to a preferred embodiment of the present invention. It should be noted that the shape and dimensions of top cover 11 correspond to the shape and dimensions of a regular magazine (respectively), such that with the bottom elements the difference from the commercially available magazines may be seen.

Figure 2A:
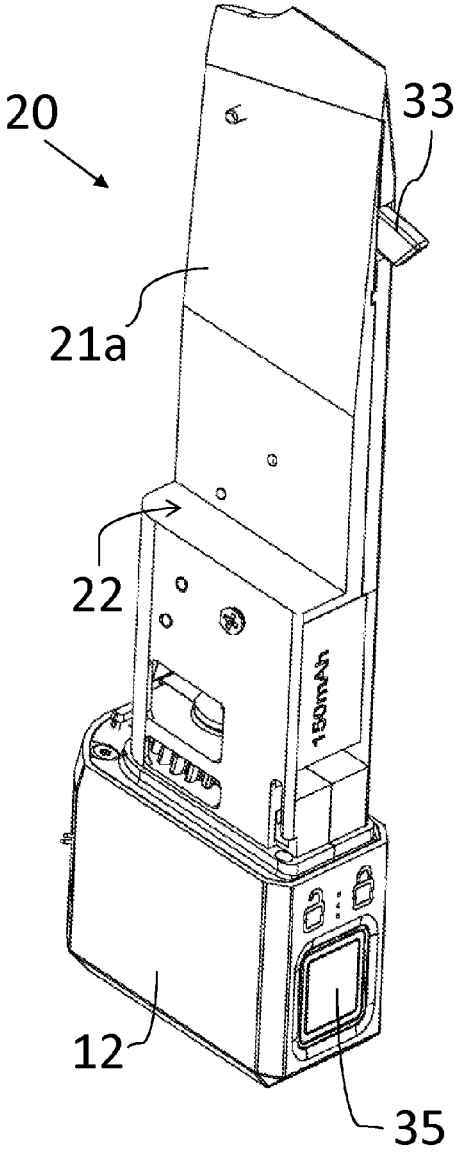
FIG. 2A illustrate a back perspective view of the safety magazine with the top cover removed, according to a preferred embodiment of the present invention.
Figure 2B:
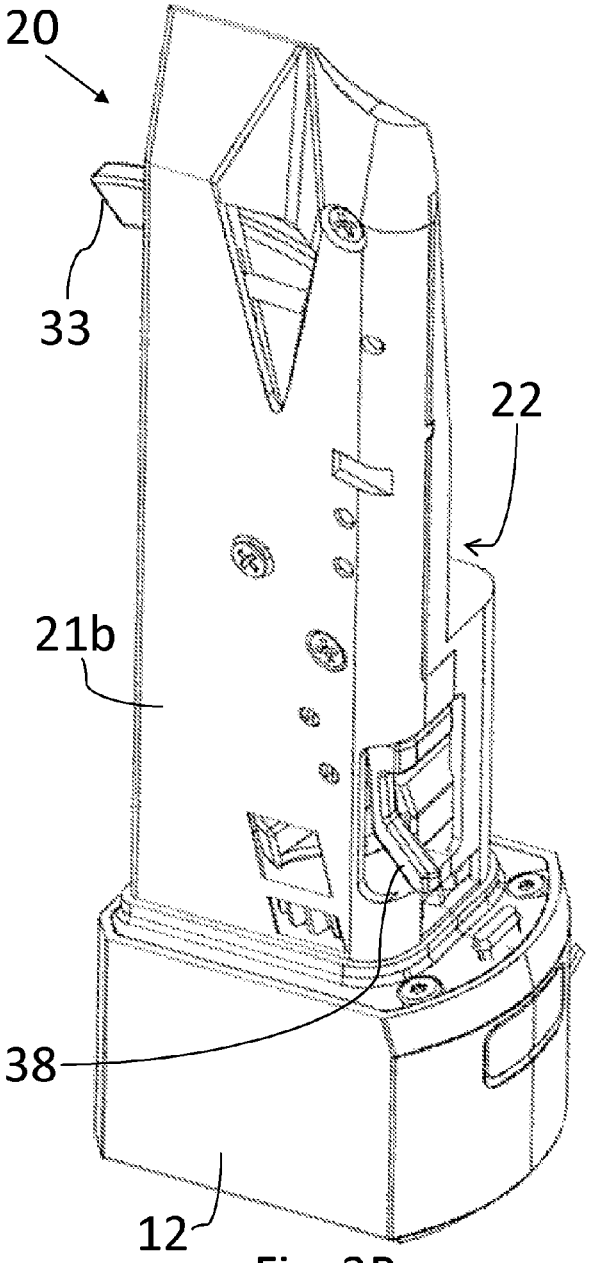
FIG. 2B illustrate a frontal perspective view of the safety magazine with the top cover removed, according to a preferred embodiment of the present invention.

Reference is now made to FIGS. 2A-2B, which illustrate back and frontal perspective views (respectively) of the safety magazine with top cover 11 removed, generally designated 20, according to a preferred embodiment of the present invention. With top cover 11 removed, safety magazine 20 may further comprise a first and second corresponding internal covers 21*a*, 21*b* that are configured to protect the mechanical elements (for the safety mechanism) within, while having a dedicated space 22 for accommodation of bullets in the magazine. Thus, safety magazine 20 may simultaneously provide standard operation of a magazine and also provide the safety mechanism, further described hereinafter. When safety magazine 20 is enabled (i.e. in an unlocked mode), the firearm may be immediately operated.

Figure 3A:
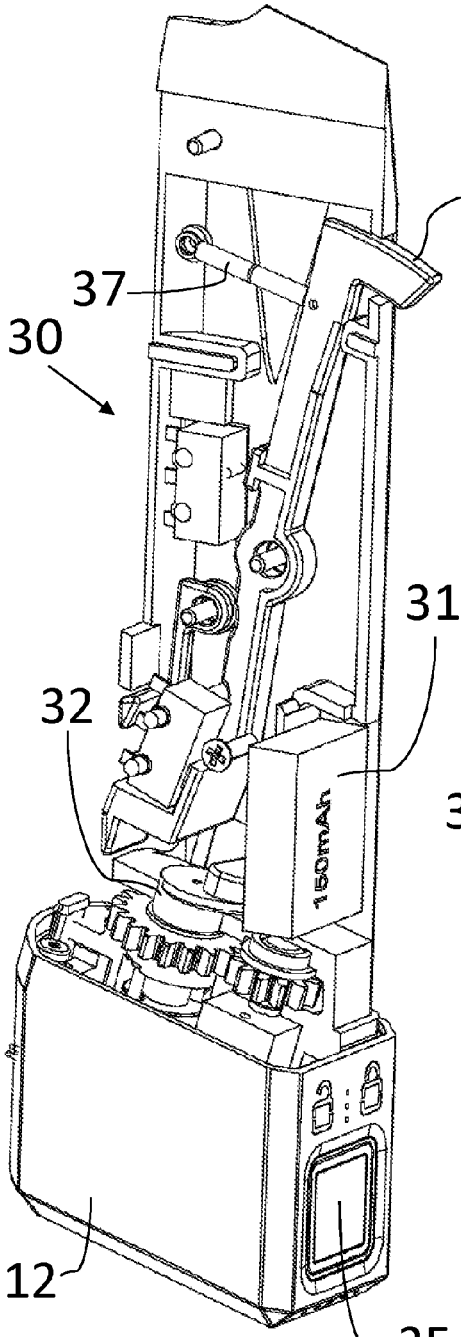
FIG. 3A illustrates a back perspective view of the safety magazine with the first internal cover removed, according to a preferred embodiment of the present invention.
Figure 3B:
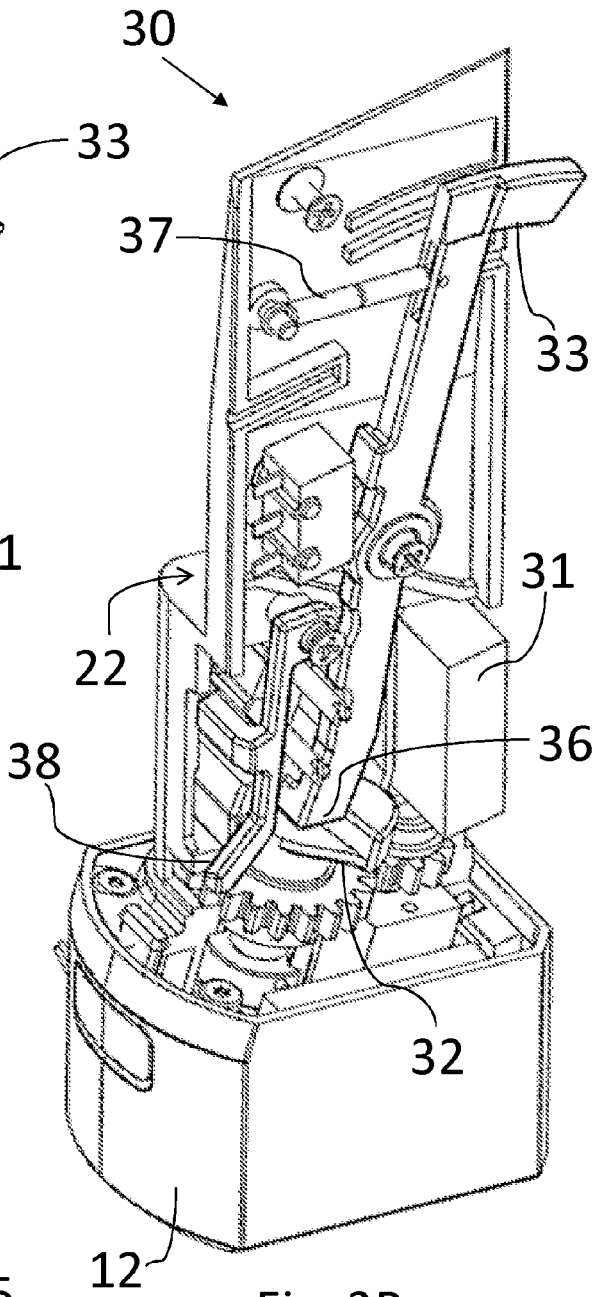
FIG. 3B illustrates a frontal perspective view of the safety magazine with the second internal cover also removed, according to a preferred embodiment of the present invention.

Reference is now made to FIGS. 3A-3B, which illustrate the safety mechanism with top cover 11 removed, generally designated 30, according to a preferred embodiment of the present invention. FIG. 3A illustrates a back perspective view of the safety magazine with first internal cover 21*a* removed, and FIG. 3B illustrates a frontal perspective view of the safety magazine with second internal cover 21*b* also removed.

The safety mechanism may include a power storage unit (e.g., a battery) 31, a top locking element (or latch) 33 capable of locking onto the magazine housing once coupled, and a cam 32. The power storage (e.g., a battery) 31 is configured to provide power for the safety mechanism, so as to allow operation of the mechanical elements. Optionally, power storage 31 may be further connected to a safety control element 35 that is embedded into bottom cover 12, so as to provide power to control element 35. Thus, the user may use control element 35 in order to control the safety magazine. For example, the user may switch between locked and unlocked modes (e.g., by pressing a button) of safety magazine 10, using control element 35. According to some embodiments, control element 35 may be configured to enable operation of the safety magazine only by authorized user(s). For example, control element may comprise identity (ID) recognition unit, e.g., finger print reader (not shown), and storage of ID data (not shown) for storing ID data of authorized users.

The cam 32 is a rotatable piece (typically in a mechanical linkage) which is adapted to convert a rotary movement into a reciprocating movement. It may be a part of a rotating wheel (e.g., a simple tooth) or a shaft that strikes a lever (making contact with the cam) or a follower at one or more points on its circular path. Cam 32 is rotatable about an axis coinciding with the center of a wheel, further described hereinafter.

It is appreciated that bottom portion 36 of top locking element 33 is adjacent to cam 32 and acts as a lever once cam 32 the bottom portion 36 during rotation. Therefore, when a locked mode is selected for safety magazine cam 32 may rotate (with electrical power from power storage 31), and thus contact bottom portion 36 such that top locking element 33 protrudes from safety magazine cover 11 and thereby engages the magazine housing of the firearm and locks thereon.

In order to unlock the locked magazine, the user may choose an unlocked mode (e.g., using control element 35) and thus move cam 32 so as to retract top locking element 33 into the magazine housing. It is appreciated that other elements may also be involved in the locking mechanism. For example, a positioning rod 37 may keep top locking element 33 on track while moving between the two states: inner state in unlocked mode and an outer state when top locking element 33 protrudes from the magazine and engages the magazine housing.

In some embodiments, the safety magazine further comprises a pivoted lever 38 that may be configured to sense whether the safety magazine is inserted into the magazine housing, wherein pivoted lever 38 may provide indication whether the magazine has been inserted into the magazine housing. For example, pivoted lever 38 may press (or release) a micro switch as the sensing means during engagement with the magazine housing. Accordingly, pivoted lever 38 enables (or disables) the controlled features of control element 35 once the safety magazine is inserted into (or removed from) the magazine housing.

Figure 4A:
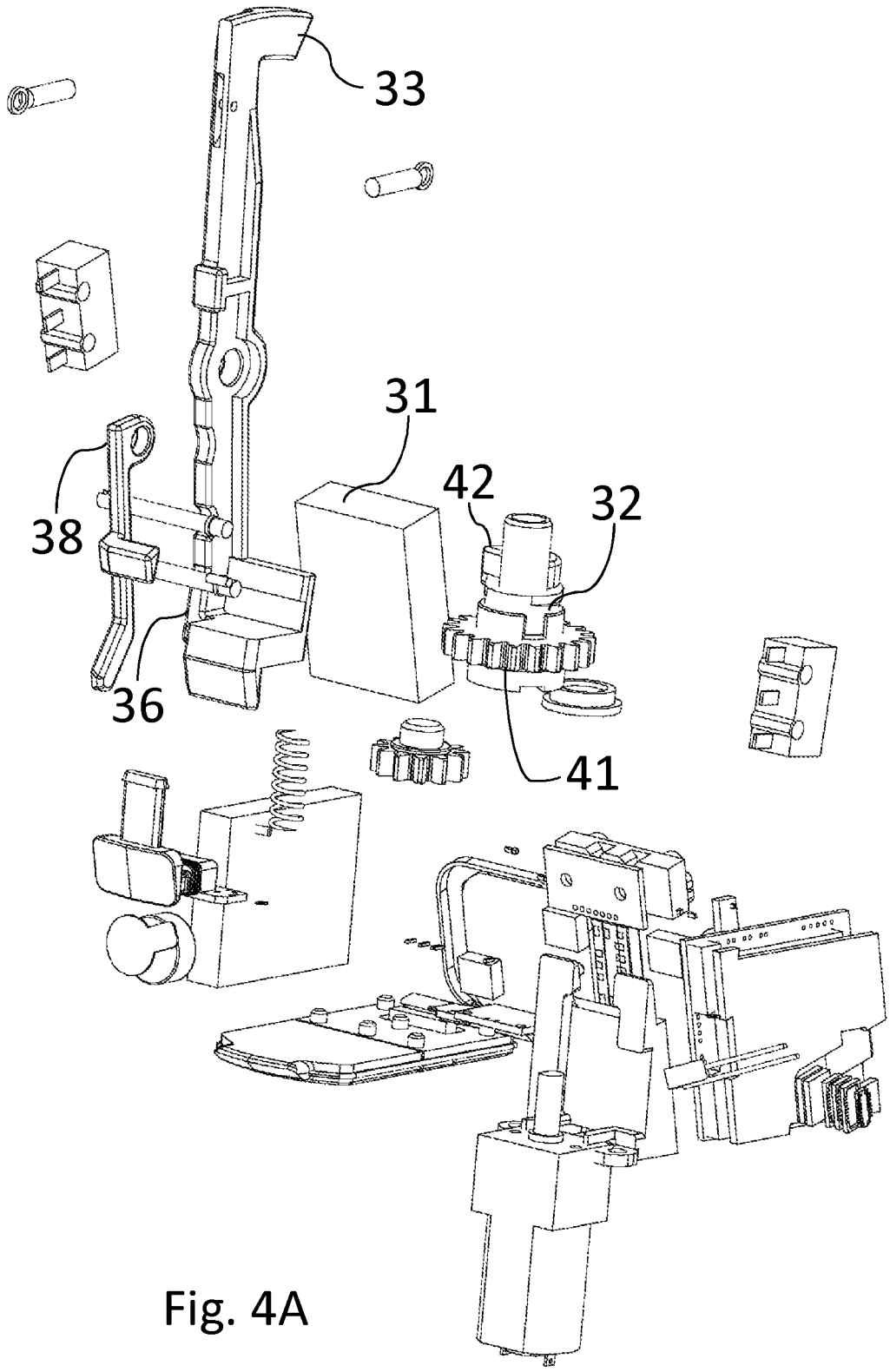
FIG. 4A illustrates an exploded view of elements of the safety mechanism of the safety magazine, according to a preferred embodiment of the present invention.
Figures 4B, 5A:
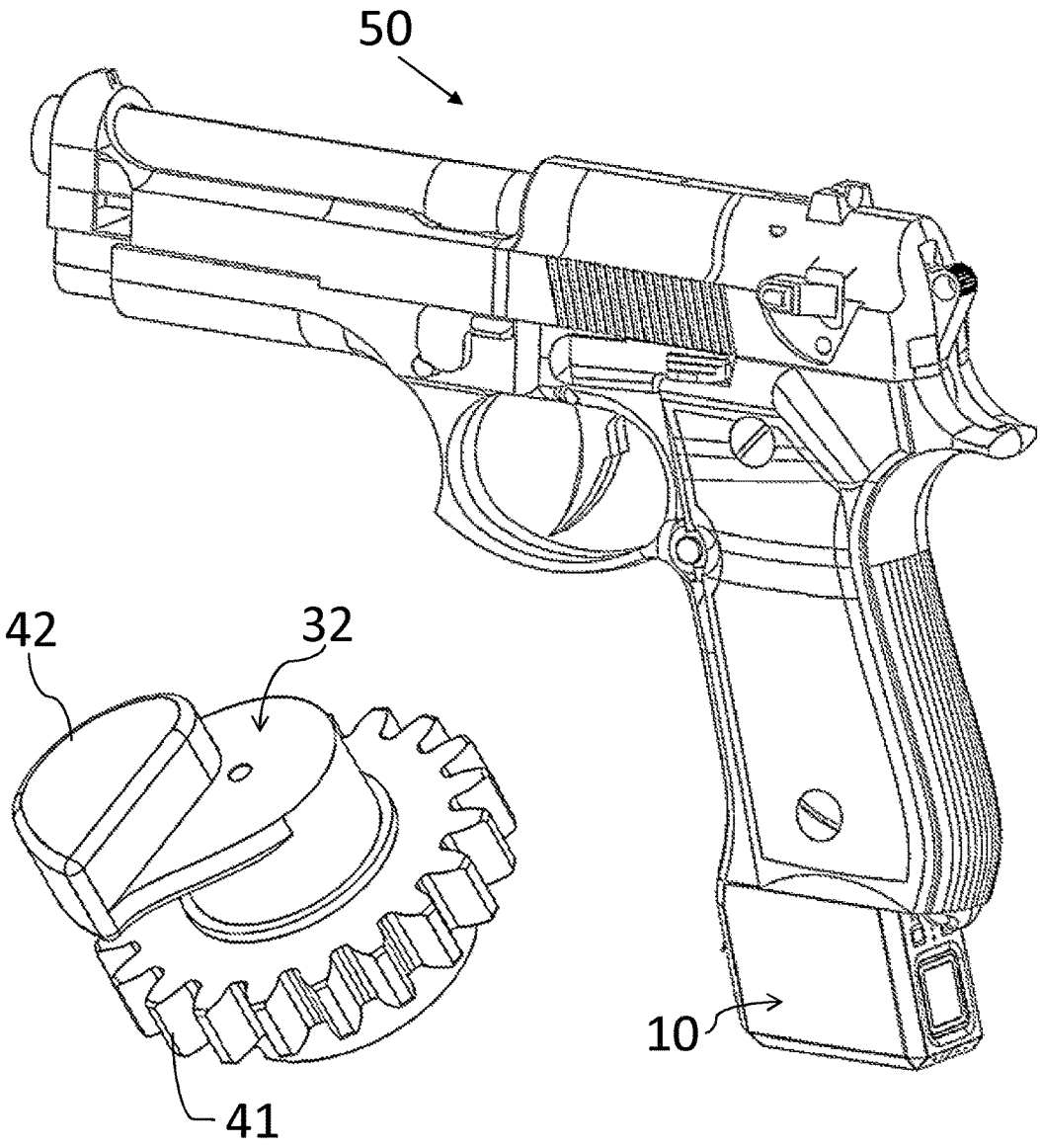
FIG. 4B illustrates a perspective view of a cogwheel with a cam, according to a preferred embodiment of the present invention.
FIG. 5A illustrates a perspective view of the safety magazine inserted into a compatible firearm, according to a preferred embodiment of the present invention.

Reference is now made to FIGS. 4A-4B, which illustrate the cam 32, according to a preferred embodiment of the present invention. FIG. 4A illustrates an exploded partial view of the mechanism of the safety magazine with cam 32 at the center, and FIG. 4B illustrates a perspective view of cam 32.

The cam 32 is mechanically engaged and positioned coaxially with cam wheel 41, and may further have a cam tooth 42 that is configured to engage bottom portion 36 (for instance as shown in FIG. 3B) of locking element 33. By rotation of cam 32, the tooth 42 engages locking element 33, such that the rotational movement of wheel 41 is converted into reciprocating movement, for example of locking element 33.

Figure 5B:
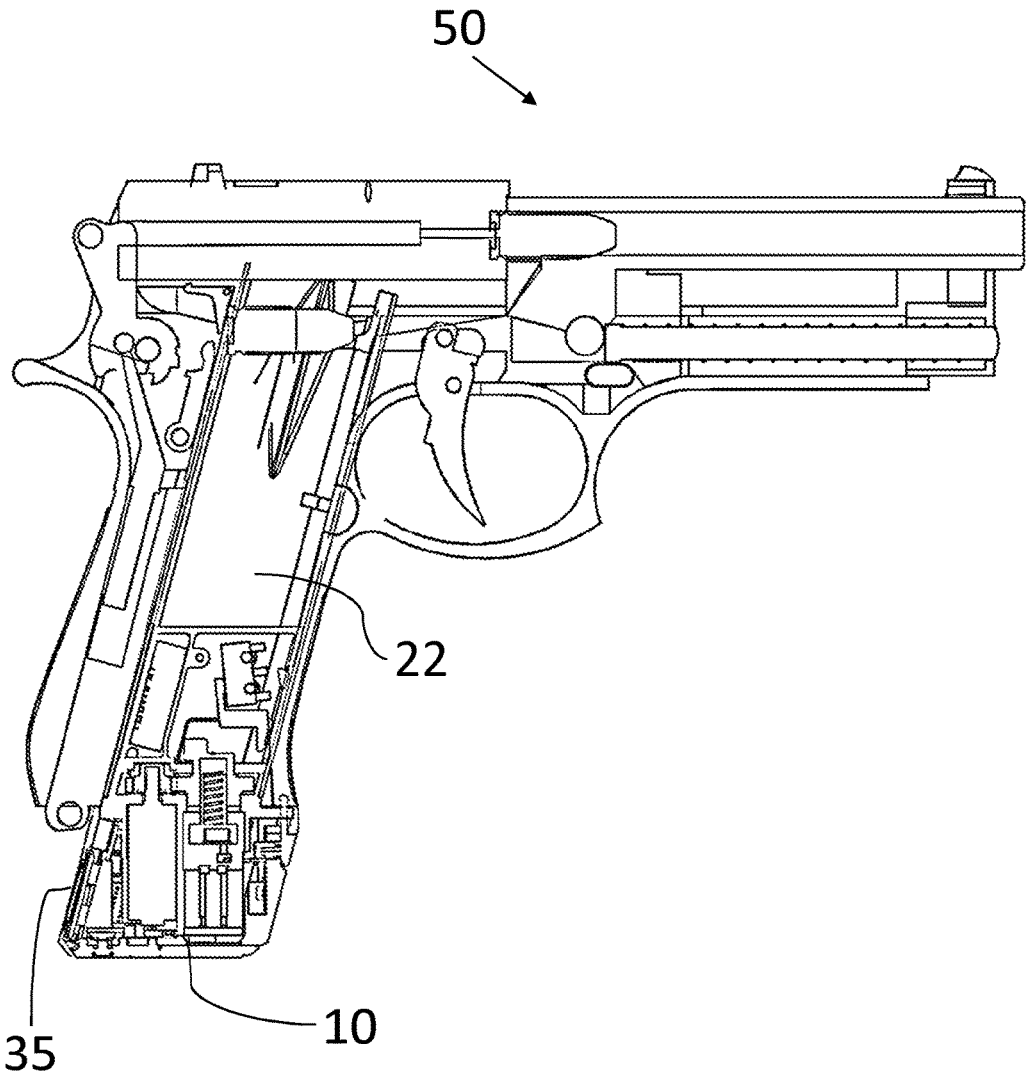
FIG. 5B illustrates a cross-sectional view of the safety magazine inserted into the firearm, according to a preferred embodiment of the present invention.

Reference is now made to FIGS. 5A-5B, which illustrate the safety magazine 10 inserted into a compatible firearm, generally designated 50, according to a preferred embodiment of the present invention. FIG. 5A illustrates a perspective view of safety magazine 10 inserted into a compatible firearm 50, and FIG. 5B illustrates a cross-sectional view of the same.

It should be noted that safety magazine 10 may be operated both as a regular magazine, storing bullets at dedicated space 22, such that firearm 50 can be used in the regular fashion, as well as be operated as a safety magazine that prevents unwanted (or unauthorized) use of firearm 50, when in locked mode.

In some embodiments, safety magazine 10 is provided in a locked state (e.g. initially locked by the user) such that, once safety magazine 10 is inserted into firearm 50, the safety magazine 10 is locked to the magazine housing (inside firearm 50) until an authorized user with a dedicated key removes the lock. For example, the user may use a physical key (such as an electronic chip configured for the particular user) in order to unlock the safety magazine 10.

In some embodiments, safety magazine 10 is provided with a physical barrier at top portion 15 (for instance as shown in FIGS. 1A-1B) that may block or otherwise prevent operation of the firearm even if a bullet is positioned near the barrel, thereby providing safety.

In some embodiments, safety magazine 10 may be provided with a biometric identification unit embedded into the bottom cover such that safety magazine 10 may be setup to identify a predetermined list of authorized users, and thereby preventing unauthorized users from using the firearm. Optionally, safety magazine 10 is also provided with a mechanical override (e.g., a physical key) to override the biometric ID unit when faulty or when the power storage runs out.

In some embodiments, the locking mechanism may further comprise a communication unit capable of receiving wireless data (e.g., via Wi-Fi, Bluetooth, GPS, or cellular networks). The communication unit may therefore allow a user to set conditions for the safety magazine to become unlocked. For example, once the safety magazine detects data that it is inside an authorized area (for instance from GPS data), then the locking is removed and the firearm may be used.

Alternatively, a dedicated signal may be wirelessly received by the safety magazine such that a user may select that in a particular time the locking is removed, no matter who operates the firearm. For example, a training officer at the police academy may wirelessly remove the locking from multiple firearms that are scheduled for practice.

In some embodiments, locking element 33 may also lock the trigger bar, an internal component of the firearm, so as to prevent discharge. Optionally, locking element 33 may disconnect the trigger from the firing pin and thereby rendering the firearm useless.

According to some embodiments, the safety mechanism may further allow locking the trigger of the firearm so as to prevent movement of the trigger to cause a discharge, as further described hereinafter. Referring now to FIGS. 6A-10B, these figures show some embodiments of the safety mechanism capable of locking the trigger of the firearm.

Figures 6A, 6B:
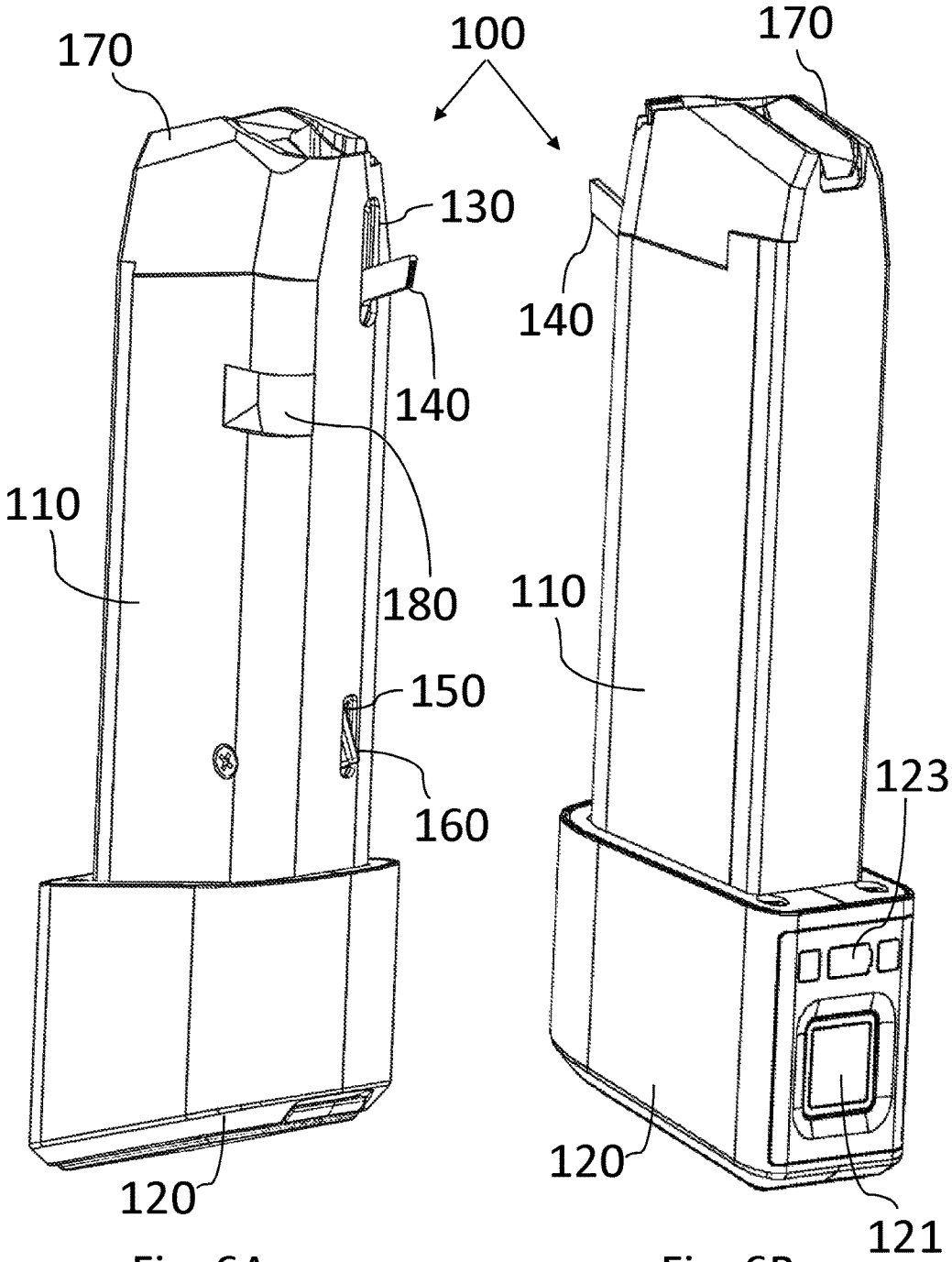
FIG. 6A illustrates a frontal perspective view of a discharge blocking device, according to a preferred embodiment of the present invention.
FIG. 6B illustrates a back perspective view of the discharge blocking device, according to a preferred embodiment of the present invention.

Reference is now made to FIGS. 6A-6B, which show a discharge blocking device, generally designated 100, according to some embodiments of the present invention. FIG. 6A illustrates a frontal perspective view (with respect to the shooting direction of the firearm) of a discharge blocking device 100, and FIG. 6B illustrates a back perspective view of the discharge blocking device 100.

It is appreciated that discharge blocking device 100 (as a safety magazine) according to the invention is adapted to allow a user, operating a firearm, to block the discharge by having the safety mechanism (within the device) in a locked mode, such that the discharge may be enabled only according to the selection by the user with the safety mechanism. Therefore, in addition to the existing safety selector on the firearm, discharge blocking device 100 may provide further means for controlling the firing mode of the firearm (i.e., locked or unlocked mode), further described hereinafter.

The discharge blocking device 100 may comprise a cover 110 having a structure that is compatible with some commercially available magazines for firearms, for instance having a shape and dimensions corresponding to and adapted to be inserted into a magazine housing of, for example, a Glock® handgun. Discharge blocking device 100 may further comprise a base 120 that at least partially covers a safety mechanism that is configured to block the discharge, further described hereinafter. Optionally, base 120 may have a shape that is larger in diameter than cover 110, such that easy gripping (of base 120) by a user operating the firearm may be allowed for insertion into and removal from the firearm. It is therefore appreciated that only with the base 120, the difference from commercially available magazines may be observed, when the safety magazine is inserted into a firearm.

In some embodiments, cover 110 may have a top segment 170 that is configured to couple with the magazine housing in a compatible firearm (not shown in FIGS. 6A-6B). Top segment 170 has an opening for insertion of cartridges therein (e.g., in a single column or staggered), such that the cartridge that is last inserted partially protrudes through top segment 170 in order to engage the firearm upon coupling with the magazine housing. Thus, operation similar to regular magazines for firearms may be enabled as discharge blocking device 100 provides accommodation of cartridges, and also engagement of these cartridges with the corresponding firearm upon coupling, as further described hereinafter.

It is appreciated that a locking element (or latch) 140, accommodated within discharge blocking device 100, may be configured to be capable of protruding from a first window 130 in cover 110. Furthermore, the operation of locking element 140 may be configured to allow locking discharge blocking device 100 to the magazine housing (of the corresponding firearm) when locking element 140 protrudes from discharge blocking device 100 and additionally lock the trigger of the firearm so as to block the discharge, as further described hereinafter. It should be noted that when discharge blocking device 100 is enabled (i.e., in an unlocked mode), the firearm may be immediately operated.

In some non-limiting embodiments, cover 110 may further comprise a recess 180 that corresponds in shape to an external magazine catch 480 (shown in FIGS. 10A-10B) in order to allow locking the position of discharge blocking device 100 within the magazine housing once the external magazine catch is inserted thereto. Thus, cover 110 may provide features similar to commercially available firearm magazines, as well as enhanced features for blocking discharge upon the selection of the user.

According to some embodiments, at least one locking switch may control the locking of discharge blocking device 100. In some embodiments, discharge blocking device 100 may further comprise a positioning lever 160 that is initially in an "open" state and configured to allow detection of discharge blocking device 100 accommodated within the magazine housing. Positioning lever 160 may be configured to be capable of protruding from a second window 150 in cover 110, such that upon insertion into the magazine housing of a firearm, positioning lever 160 may engage the inner wall of the magazine housing. Upon detection of accommodation within the magazine housing, positioning lever 160 may switch to a "closed" state. It is appreciated that positioning lever 160 may provide a first locking mechanism, that may be configured to disable the operation of the firearm unless in "closed" state. Optionally, positioning lever 160 may be coupled to a micro-switch that is capable of electrically detecting change between "open" and "closed" states, as further described hereinafter.

In some embodiments, positioning lever 160 may be operably coupled to locking element 140, wherein the coupling may be electrical or alternatively mechanical. Upon switching to a "closed" state (i.e., detection of discharge blocking device 100 within the magazine housing) by positioning lever 160, locking element 140 may be automatically operated to move to a "locked" mode and block the trigger of the firearm so as to block any discharge until the user switches to "unlocked" mode, as further described hereinafter. It should be noted that, initially, positioning lever 160 is in an "open" state and locking element 140 is in "unlocked" mode, such that upon engagement with the magazine housing positioning lever 160 switches to "closed" state and thereby locking element 140 moves to a "locked" mode. Thus, discharge blocking device 100 may automatically switch to "locked" mode and prevent discharge upon engagement with the magazine housing.

According to some embodiments, discharge blocking device 100 may further comprise a user identification segment 121. User identification segment 121 may be operably coupled to the locking mechanism within discharge blocking device 100 and thereby coupled to locking element 140 so as to disable the blocking, i.e. switch to "unlocked" mode upon identification of the user. User identification segment 121 may comprise biometric user identification (e.g. fingerprint identification), password identification with a dedicated user interface, or any other identification means (for example buttons to be pressed by the user). Optionally, user identification segment 121 may further comprise storage of ID data (not shown) for storing ID data of authorized users.

In some embodiments, discharge blocking device 100 may further comprise at least one indicator 123 that is configured to indicate the locking mode of discharge blocking device 100, e.g., "locked", "unlocked", "error", etc. Optionally, the user may control indicator 123 in order to change the mode of discharge blocking device 100, for instance pressing a button indicated "SAFE" in order to switch the device to a "locked" mode, or pressing a button indicated "FIRE" in order to switch the device to an "unlocked" mode. It should be noted that user identification segment 121 and indicator 123 may be electrically coupled to the locking mechanism so as to allow control of the locking mode of discharge blocking device 100.

Figure 6C:
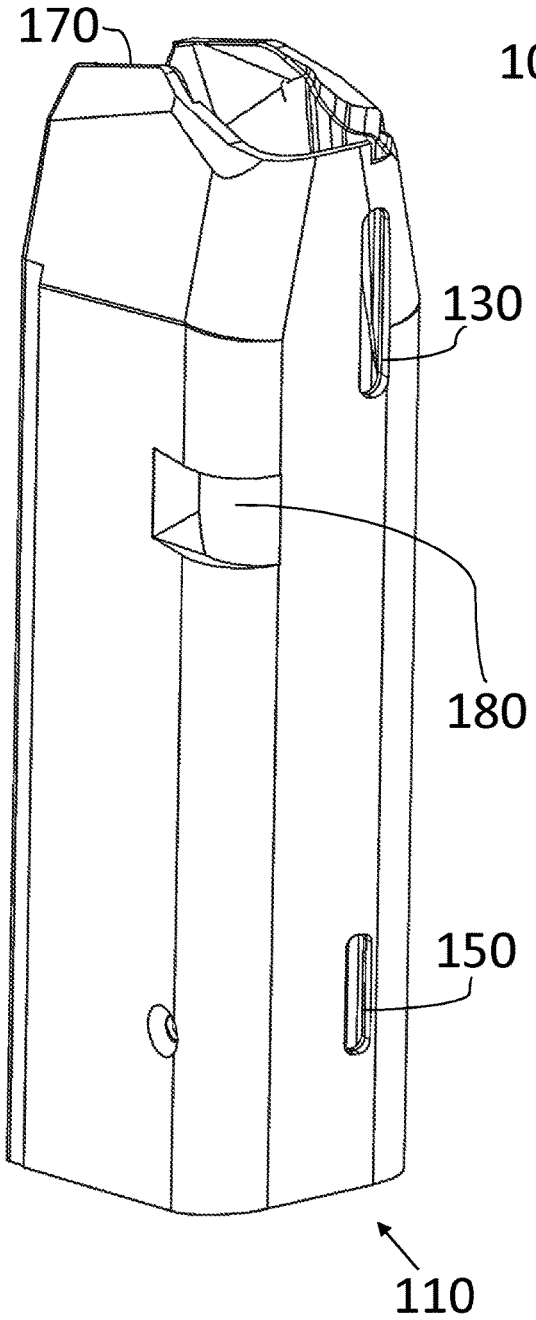
FIG. 6C illustrates a frontal perspective view of a cover of the discharge blocking device, according to a preferred embodiment of the present invention.
Figure 6D:
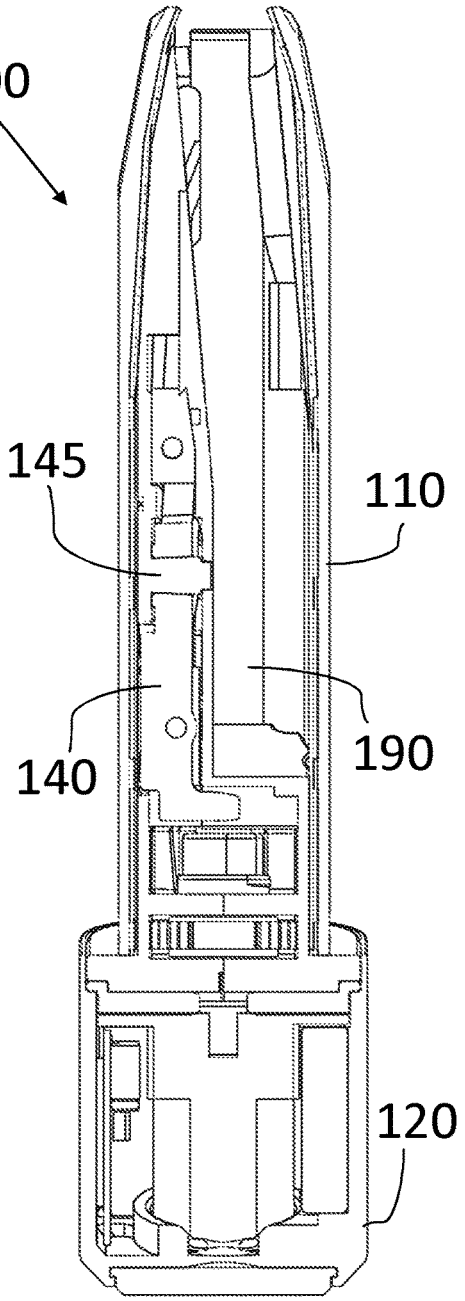
FIG. 6D illustrates a cross-sectional frontal view of the discharge blocking device, according to a preferred embodiment of the present invention.

Reference is now made to FIGS. 6C-6D, which show a frontal perspective view of a cover 110 of discharge blocking device 100 and a cross-sectional frontal view of discharge blocking device 100 (respectively), wherein the cross-section is carried out parallel to user identification segment 121, according to some embodiments of the present invention. It should be noted that discharge blocking device 100 may comprise a space 190 dedicated for accommodation of the cartridges (e.g., in a single column) as in a commercially available magazine. Thus, both locking mechanism and space 190 for accommodation of the cartridges may be covered by cover 110.

In some embodiments, the structure of cover 110 corresponds to a commercially available magazine capable of accommodating cartridges in a staggered column, such that a different number of cartridges may be accommodated within discharge blocking device 100 while an additional discharge blocking safety mechanism is provided.

According to some embodiments, locking element 140 may be pivoted about a pivot rod 145 from an "unlocked"

mode to a "locked" mode when locking element 140 protrudes from cover 110. Optionally, pivot rod 145 may be embedded as a portion of an internal segment covering the locking mechanism, as further described hereinafter (for instance as shown in FIG. 8A).

Figure 7A:
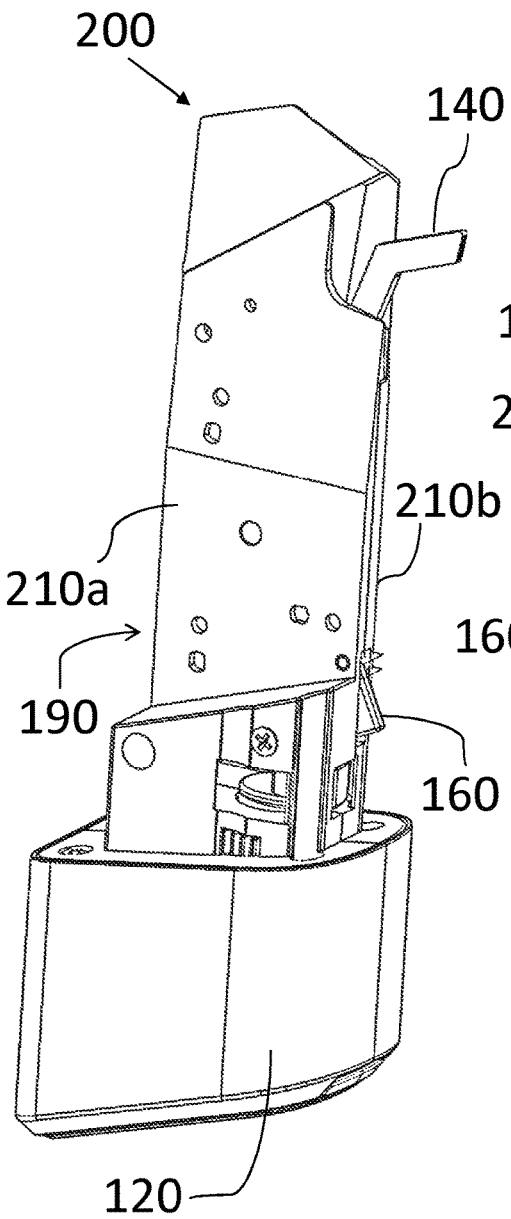
FIG. 7A illustrate a frontal perspective view of the discharge blocking device with the cover removed, according to a preferred embodiment of the present invention.
Figure 7B:
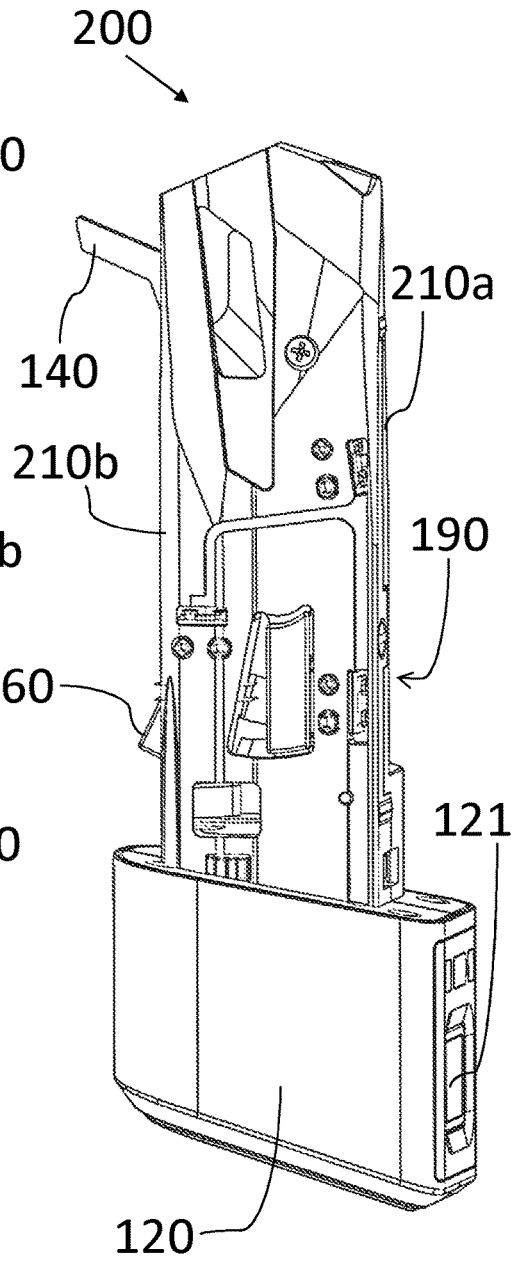
FIG. 7B illustrate a back perspective view of the discharge blocking device with the cover removed, according to a preferred embodiment of the present invention.

Reference is now made to FIGS. 7A-7B, which illustrate frontal and back perspective views (respectively) of the discharge blocking device with the cover removed, generally designated 200, according to some embodiments of the present invention. It should be noted that, with cover 110 removed, discharge blocking device 200 may further comprise a first and second corresponding internal segments 210*a*, 210*b* that are configured to be adjoined so as to cover and protect the mechanical and electrical elements (of the locking mechanism) within.

It is appreciated that the base 120 may comprise additional elements for changing the locking mode of discharge blocking device 100, as further described hereinafter.

Figure 8A:
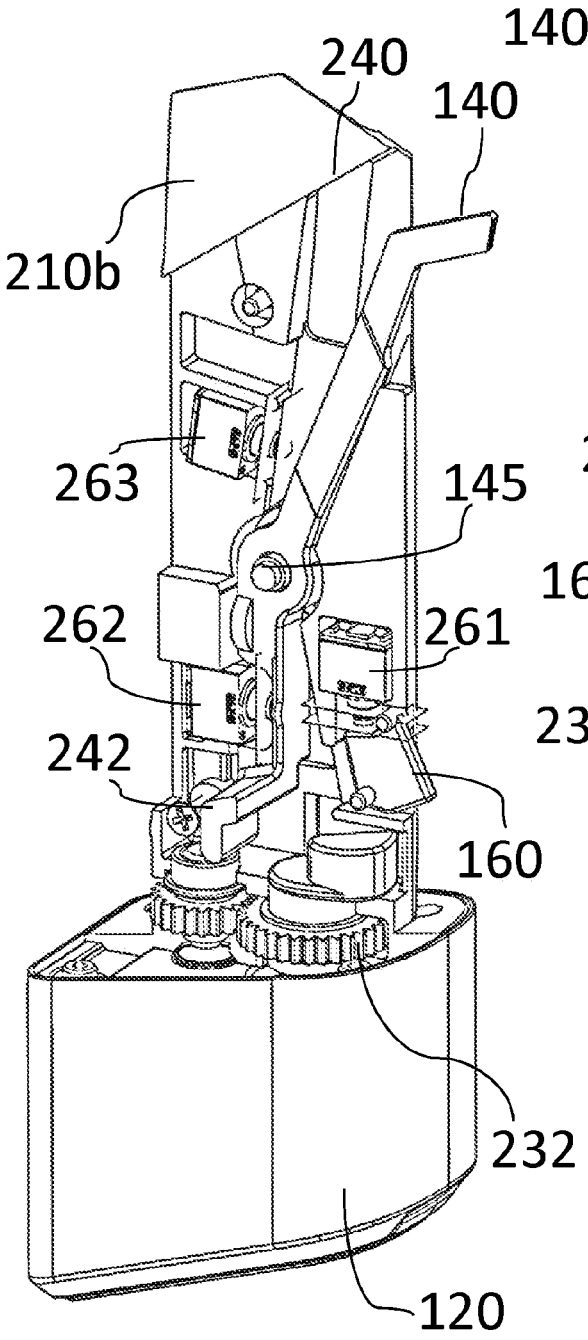
FIG. 8A illustrates a frontal perspective view of the discharge blocking device with the first internal segment removed, according to a preferred embodiment of the present invention.
Figure 8B:
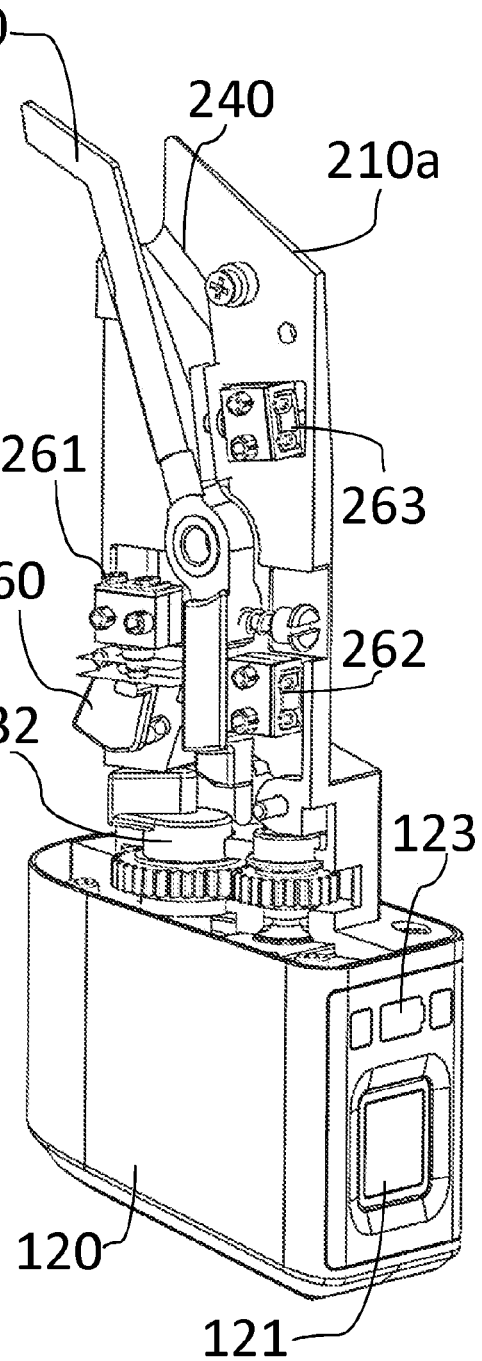
FIG. 8B illustrates a frontal perspective view of the discharge blocking device with the second internal segment removed, according to a preferred embodiment of the present invention.

Reference is now made to FIGS. 8A-8B, which show the safety mechanism within the internal segments with the cover removed, according to some embodiments of the present invention. FIG. 8A illustrates a frontal perspective view of the discharge blocking device with first internal segment 210*a* removed, and FIG. 8B illustrates a frontal perspective view of the discharge blocking device with second internal segment 210*b* removed. It is appreciated that the locking (or safety) mechanism housed inside first and second internal segments 210*a*, 210*b* comprises locking element 140 that is capable of blocking the trigger of the compatible firearm once coupled.

In case that the discharge blocking device, such as device 100, is in a locked mode (for instance as shown in FIGS. 8A-8B), the user may use for example user identification segment 121 to unlock the device (or other identification options). Thus, locking element 140 moves from a "locked" mode (i.e., protruding to block the trigger of a firearm) to an "unlocked" mode. During this movement, locking element 140 retracts inwardly into cover 110 until locking element 140 engages a back surface 240 such that locking element 140 no longer protrudes from the discharge blocking device, i.e., no longer protrudes from first window 130 (for instance as shown in FIG. 6A). In the opposite case, the user may control user identification segment 121 to lock the device, or by inserting the device into magazine housing thereby activating positioning lever 160. Specifically, moving locking element 140 to protrude from the discharge blocking device so as to engage the magazine housing of the firearm and block any discharge.

It is appreciated that, similar to the safety magazine described in FIGS. 1A-4A, the locking mechanism of discharge blocking device may also comprise a cam 232 with similar function wherein rotational movement is converted into reciprocating movement. Particularly, movement of cam 232 may engage panel 242 of locking element 140 so as to move locking element 140 from a "locked" mode to "unlocked" mode (or vice versa).

In some embodiments, the control of the movement of locking element 140 by the user may be carried out mechanically (e.g., with a dedicated key) or alternatively carried out electrically (e.g., with a dedicated switch), as further described hereinafter.

Figure 8C:
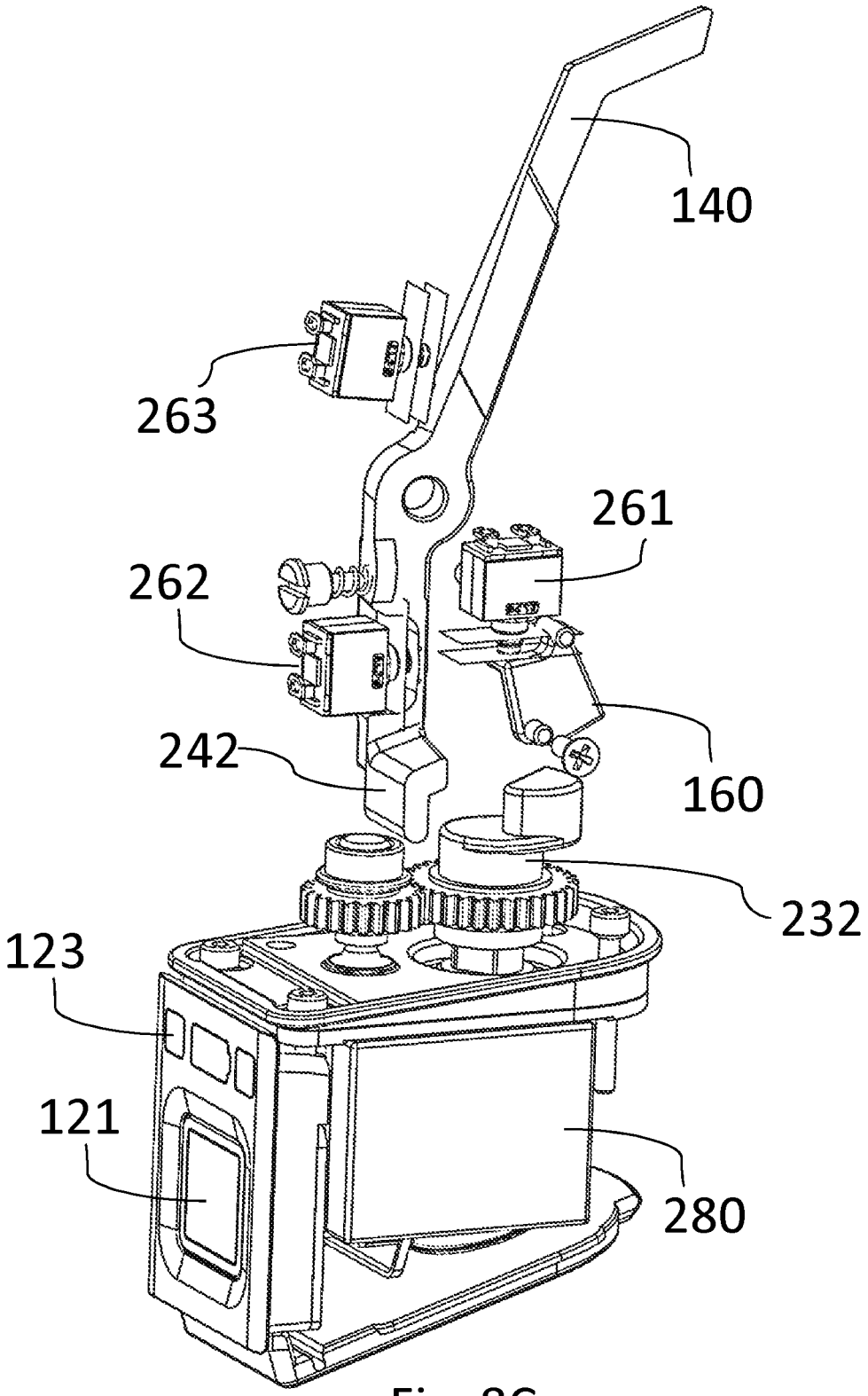
FIG. 8C illustrates an exploded view of the safety mechanism within the discharge blocking device with the internal segments removed, according to a preferred embodiment of the present invention.

In some non-limiting embodiments, the safety mechanism may further comprise a power storage unit 280, e.g. a battery, (for instance, as shown in FIG. 8C) that is configured to provide power for the safety mechanism, so as to allow operation of the mechanical elements. Optionally, a battery status indicator may also be provided with the indicators 123, for instance as shown in FIG. 6B.

It is appreciated that, in order for locking mode indication on user identification segment 121, at least one switch may provide such indication, for instance with an electrical signal. A first switch 261 may be operably coupled to positioning lever 160 and provide an indication to user identification segment 121 regarding the state of discharge blocking device being inside a magazine housing (i.e., in "open" or "closed states). Specifically, movement of positioning lever 160 may engage first switch 261 when accommodated within a magazine housing since positioning lever 160 is pushed into the device due to engagement with the walls of the magazine housing.

A second switch 262 may be operably coupled to panel 242 and provide an indication to user identification segment 121 regarding the state of discharge blocking device being in "locked" or "unlocked" modes. Specifically, movement of panel 242 may engage second switch 262 when in "locked" mode (as shown in FIGS. 8A-8B) due to locking element 140 protruding and blocking the trigger of the firearm, thereby causing panel 242 to move backward towards user identification segment 121 and to engage second switch 262.

A third switch 263 may be operably coupled to body of locking element 140 and provide an indication to user identification segment 121 regarding the state of discharge blocking device being in "locked" or "unlocked" modes. Specifically, movement of locking element 140 may engage third switch 263 when in "unlocked" mode due to locking element 140 engaging back surface 240, thereby causing locking element 140 to move backward towards user identification segment 121 and to engage third switch 263. It should be noted that, in a "locked" mode, second switch 262 may provide indication due to engagement with panel 242, and, in the opposite case, in an "unlocked" mode, third switch 263 may provide indication due to engagement with back surface 240, whereby there is no indication between "locked" and "unlocked" modes since the second and third switches 262, 263 are not engaged.

It is appreciated that, upon insertion into a magazine housing, discharge blocking device may become automatically in a "closed" state with positioning lever 160 engaging first switch 261 and thereby moving the device into a "locked" mode, with locking element 140 protruding and blocking the trigger of the firearm. In some embodiments, an electrical signal from first switch 261 may initiate movement of cam 232 to engage panel 242 and thereby move locking element 140 to protrude from the device. Alternatively, movement of positioning lever 160 mechanically moves cam 232 to engage panel 242.

It should be noted that user identification segment 121 may provide indication of "locked" or "unlocked" mode due to corresponding signals from second and third switches 262, 263. Optionally, user identification segment 121 may also provide indication of proper accommodation within the magazine housing with a corresponding signal from first switch 261.

It is appreciated that the indication provided with second and third switches may improve reliability of the safety mechanism, as well as preventing stopping of locking element movement mid-way, between "locked" and "unlocked" modes.

Reference is now made to FIG. 8C, which illustrates an exploded view of the safety mechanism within the discharge blocking device with the internal segments removed, according to some embodiments of the present invention. In some embodiments, a central controller (not shown) may control the operation of discharge blocking device. Specifically, such a controller may control user identification segment 121 switching between "locked" and "unlocked" modes.

Figures 9A, 9B:
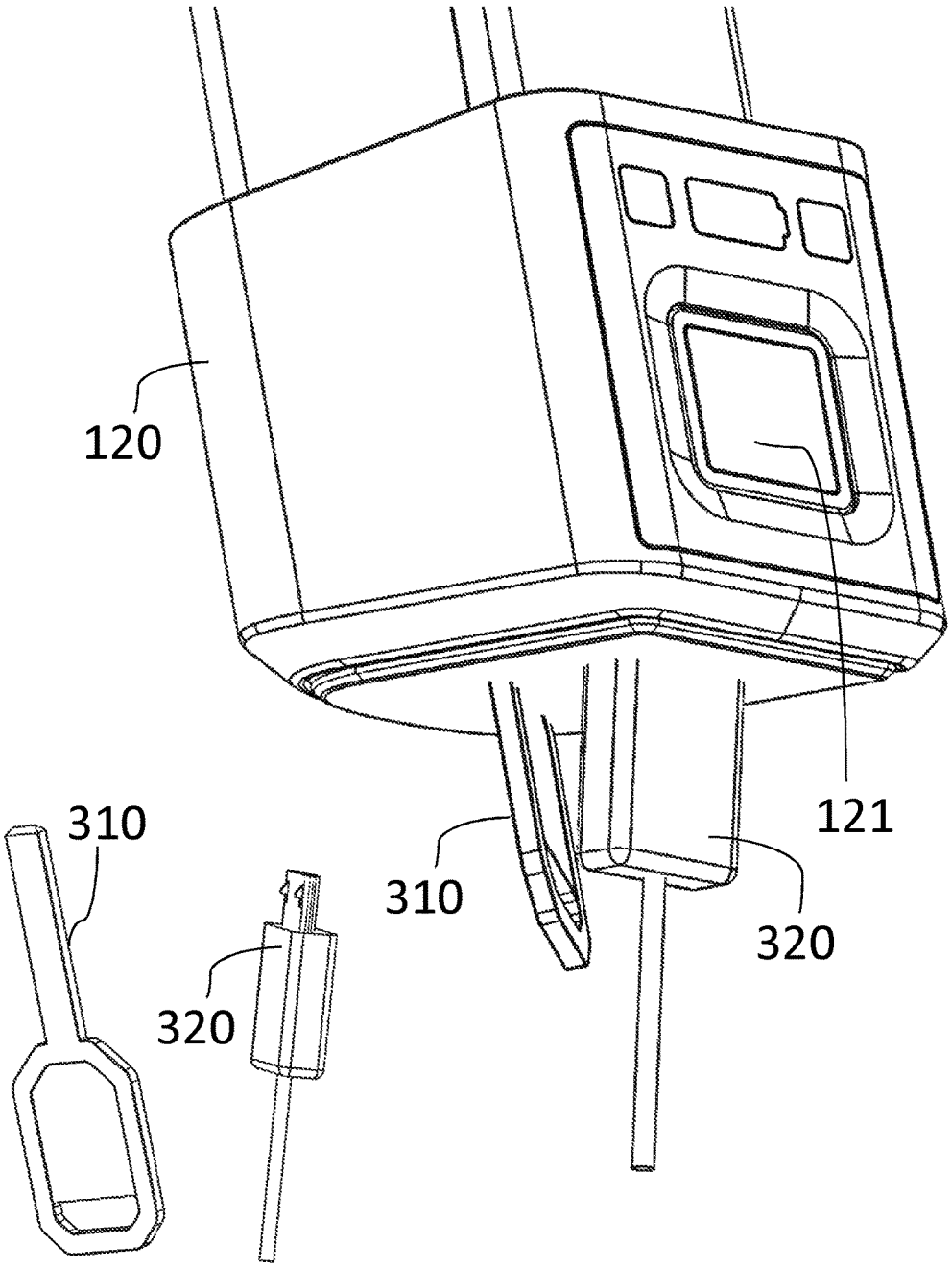
FIG. 9A illustrates a perspective view of a physical key and a media device, according to a preferred embodiment of the present invention.
FIG. 9B illustrates a bottom perspective view of the physical key and media device inserted into the base of the discharge blocking device, according to a preferred embodiment of the present invention.
Figure 9C:
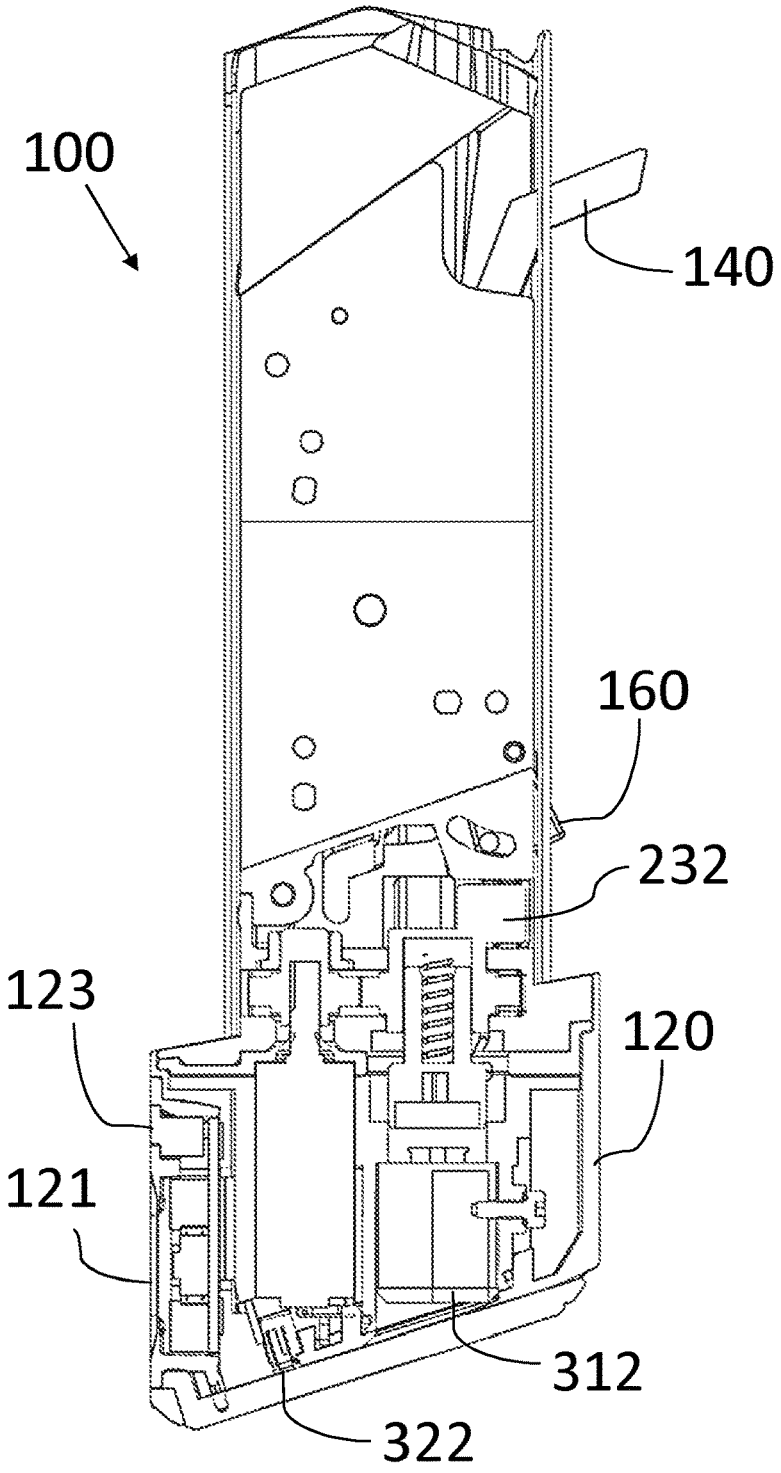
FIG. 9C illustrates a cross-sectional view of discharge blocking device, according to a preferred embodiment of the present invention.

Reference is now made to FIGS. 9A-9C, which show additional means for user identification with the discharge blocking device, according to some embodiments of the present invention. FIG. 9A illustrates a perspective view of a physical key 310 and a media device 320. FIG. 9B illustrates a bottom perspective view of the physical key 310 and media device 320 inserted into the base 120 of the discharge blocking device. FIG. 9C illustrates a cross-sectional view of discharge blocking device 100, wherein the cross-section is parallel to locking element 140. It should be noted that other identification methods may also be possible, for instance radio-frequency identification (RFID), near-field-communication (NFC), etc.

According to some embodiments, in addition to the user identification segment 121, discharge blocking device may further be configured to allow coupling with other identification devices, for instance in case that user identification segment 121 has a malfunction or when the power storage runs out. A unique physical key 310 may be provided to the user to be inserted into a dedicated slot 312 within base 120 so as to allow manually moving to an "unlocked" device. In some embodiments, insertion of key 310 into slot 312 may allow engaging key 310 with cam 232, such that manual rotation of key 310 therein (by the user) may consequently rotate cam 232 and thereby move locking element to an "unlocked" mode.

In some embodiments, a media device 320 (e.g., USB flash drive, or PC) may be provided to the user, comprising unique information, that may unlock the discharge blocking device upon insertion of media device 320 therein. Optionally, such media device 320 may allow connection to a computerized device (e.g., PC or smartphone) in order to allow management of authorized users as well as performing maintenance.

Figure 10A:
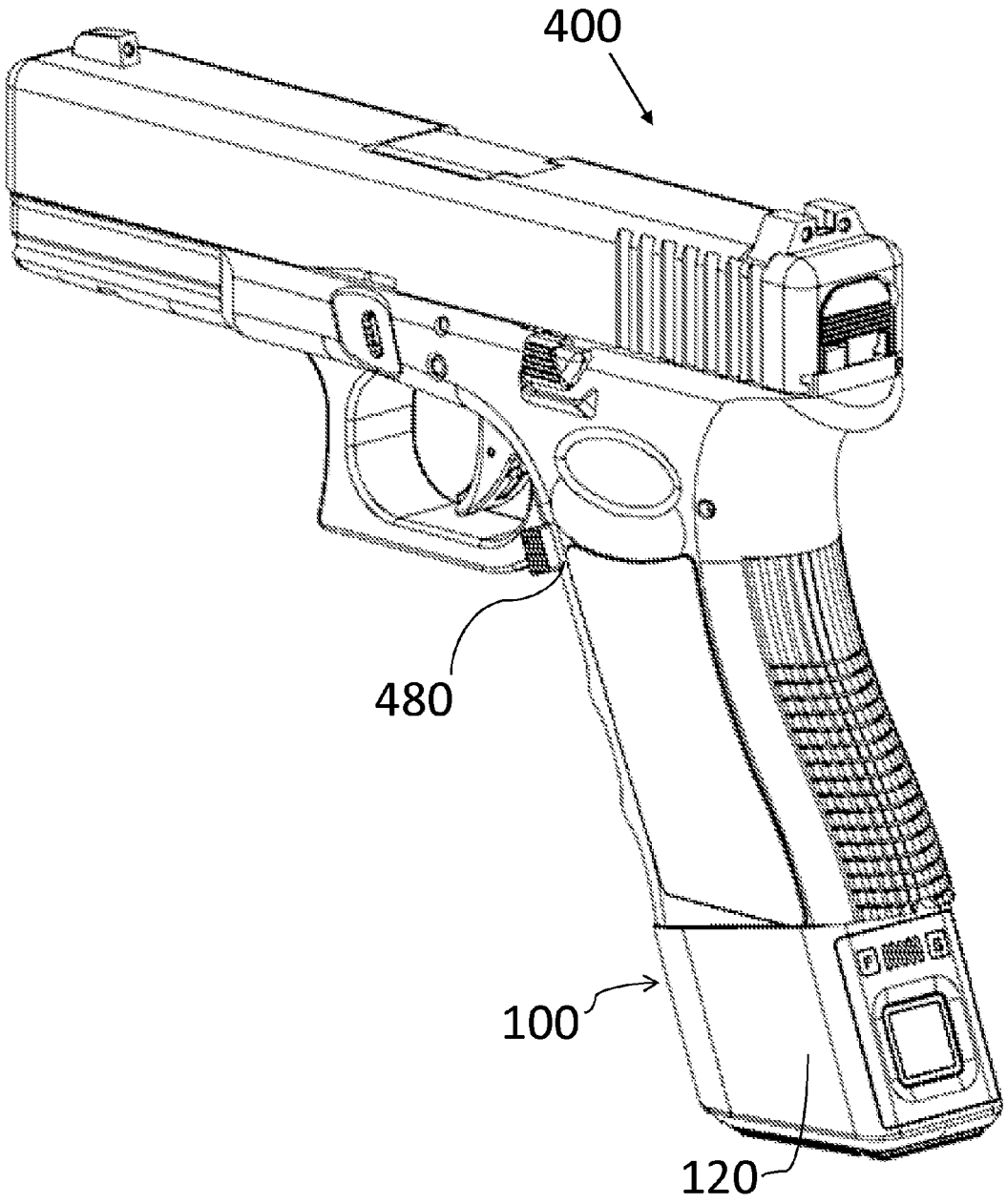
FIG. 10A illustrates a perspective view of the discharge blocking device inserted into a compatible firearm, according to a preferred embodiment of the present invention.
Figure 10B:
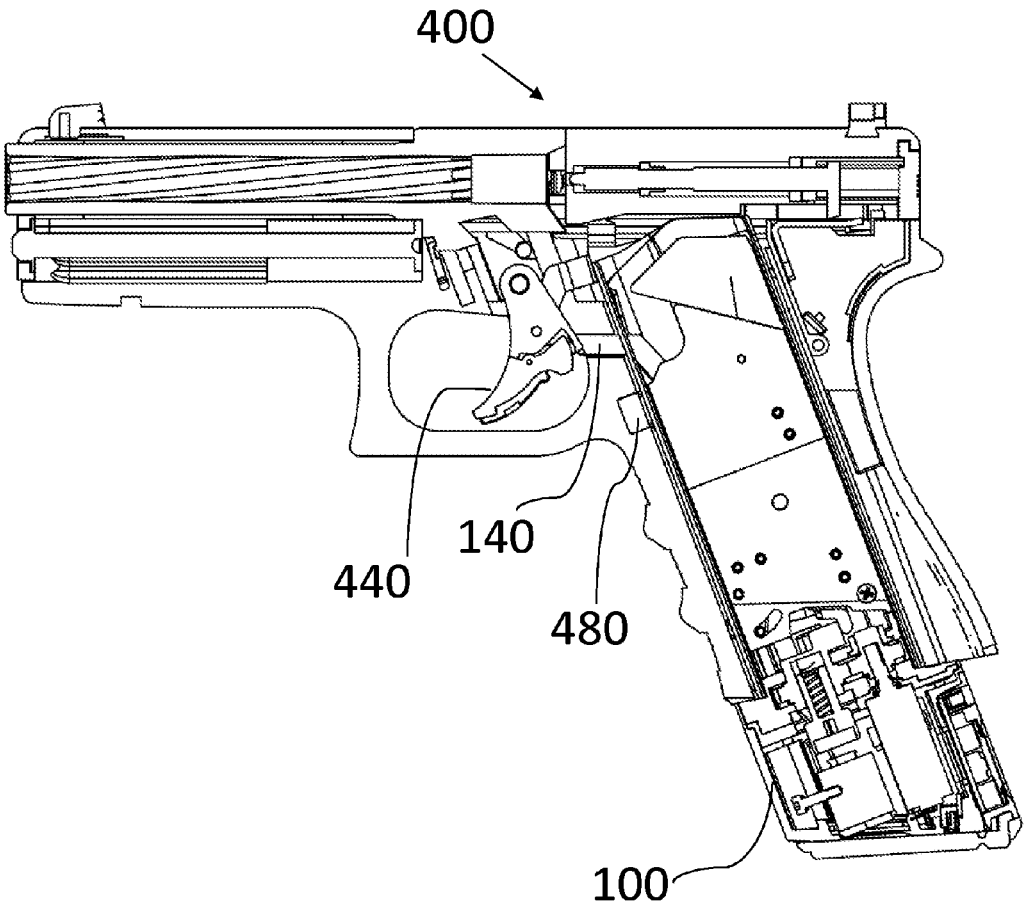
FIG. 10B illustrates a cross-sectional view of the discharge blocking device inserted into the firearm, according to a preferred embodiment of the present invention.

Reference is now made to FIGS. 10A-10B, which illustrate the discharge blocking device 100 inserted into a compatible firearm, generally designated 400, according to some embodiments of the present invention. FIG. 10A illustrates a perspective view of discharge blocking device 100 inserted into a compatible firearm 400, and FIG. 10B illustrates a cross-sectional view of the same.

It should be noted that discharge blocking device 100 may be operated both as a regular magazine, storing cartridges at dedicated space 190, such that firearm 400 can be used in the regular fashion, as well as be operated as a discharge blocking device that prevents unwanted (or unauthorized) use of firearm 400, when in locked mode.

It is appreciated that, in a locked mode (as shown in FIG. 10B), locking element 140 protrudes from the discharge blocking device 100 to approach close to trigger 440 of firearm 400. Thus, the user cannot squeeze trigger 440 to discharge firearm 400 (in a locked mode) since locking element 140 prevents any backward movement of trigger 440. In order to allow discharge, the user may change the state of discharge blocking device 100 from "locked" to "unlocked", for example by using the user identification segment such that locking element 140 moves backwards and no longer protrudes through the discharge blocking device 100, and then trigger 440 may be operated to discharge firearm 400.

In some embodiments, in addition to blocking the trigger of the firearm, locking element 140 may also prevent removal of the discharge blocking device 100 from the magazine housing.

It should be noted that, in contrast to the safety magazine that is capable of locking onto the magazine housing as described in FIGS. 1A-4A, discharge blocking device 100 has a locking element that is directed to the opposite direction, i.e., towards the barrel of the firearm, in order to allow blocking the trigger of the firearm with the locking element.

In some embodiments, discharge blocking device 100 is provided with a physical barrier at top segment that may block or otherwise prevent operation of the firearm even if a cartridge is positioned near the barrel, thereby providing extra safety.

In some embodiments, the locking mechanism may further comprise a communication unit capable of sending and receiving wireless data (e.g., via Wi-Fi, Bluetooth, GPS, or cellular networks). The communication unit may therefore allow a user to set conditions for the discharge blocking device to become unlocked. For example, once the discharge blocking device detects data that it is inside an authorized area (for instance from GPS data), then the locking is removed and the firearm may be used.

Alternatively, a dedicated signal may be wirelessly received by the discharge blocking device such that a user may select that in a particular time the locking is removed, no matter who operates the firearm. For example, a training officer at the police academy may wirelessly remove the locking from multiple firearms that are scheduled for practice.

While certain features of the invention have been illustrated and described herein, many modifications, substitutions, changes, and equivalents may occur to those skilled in the art. It is, therefore, to be understood that the appended claims are intended to cover all such modifications and changes as fall within the true spirit of the invention.

Various embodiments have been presented. Each of these embodiments may of course include features from other embodiments presented, and embodiments not specifically described may include various features described herein.

The invention claimed is:

1. A magazine for a firearm having a frame defining a magazine well and having a trigger forward of the magazine well having a range of motion between a forward released position and a rearward discharge position, the magazine comprising: an elongated body adapted to be closely and removably received in the magazine well; and a locking element connected to the elongated body and movable between a retracted position and an extended position;

wherein the locking element has a single protrusion adapted to enable movement of the trigger to the rearward discharge position and to enable extraction of the magazine from the magazine well when in the retracted position; and wherein the single protrusion is adapted to directly contact the trigger to prevent movement of the trigger to the rearward discharge position and to prevent extraction of the magazine from the magazine well when in the extended position.

2. The magazine according to claim 1, wherein the locking element is pivotally connected to the elongated body.

3. The magazine according to claim 1, wherein the firearm trigger has an upper end pivotally connected to the frame and a lower free end, and wherein the single protrusion is adapted to contact the trigger at an intermediate position between the upper end and the lower free end.

4. The magazine according to claim 1, wherein the elongated body defines an external profile surface, and wherein the single protrusion is received within the external profile surface when in the retracted position and extends from the external profile surface when in the extended position.

5. The magazine according to claim 1, wherein the elongated body defines a primary axis, and wherein the single protrusion moves laterally to the primary axis.

6. The magazine according to claim 1, further comprising a locking mechanism configured to prevent movement of the locking element.

7. The magazine according to claim 6, wherein the locking mechanism comprises an electronic lock.

8. The magazine according to claim 6, wherein the locking mechanism is connected to a user identification unit.

9. The magazine according to claim 8, wherein the user identification unit is configured for biometric identification.

10. The magazine according to claim 6, wherein the locking mechanism comprises a mechanical lock configured to receive a physical key.

11. The magazine according to claim 10, wherein the physical key comprises an electronic chip.

12. The magazine according to claim 6, wherein the locking mechanism comprises an electronic lock and a mechanical lock.

13. The magazine according to claim 1, wherein the elongated body has a dedicated space configured to accommodate ammunition.

14. The magazine according to claim 1, further comprising an insert indicator configured to indicate when the magazine is not fully inserted into the magazine well.

15. The magazine according to claim 1, further comprising a power source.

16. The magazine according to claim 15, further comprising a power source indicator.

17. The magazine according to claim 1, further comprising a lock indicator configured to indicate when the locking element is in an extended position.

18. A magazine for a firearm having a frame defining a magazine well and having a trigger having a range of motion between a forward released position and a rearward discharge position, the magazine comprising:

an elongated body adapted to be closely and removably received in the magazine well;

a locking element connected to the elongated body and movable between a retracted position and an extended position;

wherein the locking element has a single protrusion adapted to enable movement of the trigger to the rearward discharge position and to enable extraction of the magazine from the magazine well when in the retracted position;

wherein the single protrusion is adapted to prevent movement of the trigger to the rearward discharge position and to prevent extraction of the magazine from the magazine well when in the extended position; and wherein the elongated body has a front wall facing the trigger, and the front wall defines an aperture from which the single protrusion protrudes when the locking element is in the extended position.

19. A magazine for a firearm having a frame defining a magazine well and having a trigger having a range of motion between a forward released position and a rearward discharge position, the magazine comprising:

an elongated body adapted to be closely and removably received in the magazine well; a locking element connected to the elongated body and movable between a retracted position and an extended position;

wherein the locking element has a single protrusion adapted to enable movement of the trigger to the rearward discharge position and to enable extraction of the magazine from the magazine well when in the retracted position;

wherein the single protrusion is adapted to prevent movement of the trigger to the rearward discharge position and to prevent extraction of the magazine from the magazine well when in the extended position; and wherein the locking element is pivotally connected to the elongated body to pivot about a horizontal pivot axis disposed through the locking element.

20. A magazine for a firearm having a frame defining a magazine well and having a trigger having a range of motion between a forward released position and a rearward discharge position, the magazine comprising:

an elongated body adapted to be closely and removably received in the magazine well; a locking element connected to the elongated body and movable between a retracted position and an extended position;

wherein the locking element has a single protrusion adapted to enable movement of the trigger to the rearward discharge position and to enable extraction of the magazine from the magazine well when in the retracted position;

wherein the single protrusion is adapted to prevent movement of the trigger to the rearward discharge position and to prevent extraction of the magazine from the magazine well when in the extended position;

wherein the elongated body is a tubular body defining an interior space; and wherein the single protrusion is contained within the interior space when in the retracted position and extends out of the interior space when in the extended position.

* * * * *